US012338641B2

(12) United States Patent
Asakura

(10) Patent No.: US 12,338,641 B2
(45) Date of Patent: Jun. 24, 2025

(54) REBAR TYING TOOL

(71) Applicant: MAKITA CORPORATION, Anjo (JP)

(72) Inventor: Yuta Asakura, Anjo (JP)

(73) Assignee: MAKITA CORPORATION, Anjo (JP)

( * ) Notice: Subject to any disclaimer, the term of this patent is extended or adjusted under 35 U.S.C. 154(b) by 335 days.

(21) Appl. No.: 18/179,483

(22) Filed: Mar. 7, 2023

(65) Prior Publication Data

US 2023/0349177 A1 Nov. 2, 2023

(30) Foreign Application Priority Data

Apr. 1, 2022 (JP) ..... 2022-061997
Jul. 1, 2022 (JP) ..... 2022-107137

(51) Int. Cl.
*E04G 21/12* (2006.01)

(52) U.S. Cl.
CPC ..... *E04G 21/123* (2013.01)

(58) Field of Classification Search
CPC ..... B21F 15/00; B21F 15/02; B21F 15/04; B65B 13/22; B65B 13/28; B65B 13/285; B65B 13/025; B65B 13/04; B65B 13/06; B65B 27/10; B25B 25/00; E04G 21/123
See application file for complete search history.

(56) References Cited

U.S. PATENT DOCUMENTS 5,279,336 A 1/1994 Kusakari et al.
5,831,404 A 11/1998 Ishii
5,874,816 A 2/1999 Ishii
5,944,064 A 8/1999 Saito et al.
7,398,800 B2 7/2008 Kusakari et al.
7,448,417 B2 11/2008 Itagaki
9,004,114 B2 4/2015 Kasahara et al.
(Continued)

FOREIGN PATENT DOCUMENTS

CN 201656223 U 11/2010
CN 106347734 A * 1/2017 ..... B65B 13/22
(Continued)

OTHER PUBLICATIONS

Translation of CN-106347734.*
Translation of JP-2012526935.*
Translation of DE-102016124850.*

*Primary Examiner* — Bobby Yeonjin Kim
(74) *Attorney, Agent, or Firm* — J-TEK LAW PLLC; Jeffrey D. Tekanic; Scott T. Wakeman

(57) ABSTRACT

A rebar tying tool ties together two or more rebars using a wire. The rebar tying tool may include: a reel comprising the wire wound on a bobbin; a reel-holding part configured to hold the reel in a rotatable manner; a feed part configured to advance the wire from the reel by a number of turns of the wire around the rebars; and a twisting part configured to twist the wire after the number of turns of the wire has been wound around the rebars. The wire preferably has a maximum tensile load of at least 700 N. Preferably, the wire after the number of turns of the wire has been wound around the rebars has an overall maximum tensile load of at least 1,050 N, which is calculated by multiplying the maximum tensile load of the wire by the number of turns of the wire around the rebars.

19 Claims, 19 Drawing Sheets

| | Tensile Strength (MPa) | Wire Diameter (mm) | Cross-Sectional Area ($mm^2$) | Winding Count (times) | Overall Cross-Sectional Area ($mm^2$) | Overall Maximum Tensile Load (N) | Yield Stress (MPa) | Overall Yield-Point Load (N) |
|---|---|---|---|---|---|---|---|---|
| 1 | 350 | 1.6 | 2.01 | 1 | 2.01 | 703 | 233 | 469 |
| 2 | 350 | 2.0 | 3.14 | 1 | 3.14 | 1099 | 233 | 733 |
| 3 | 350 | 2.4 | 4.52 | 1 | 4.52 | 1583 | 233 | 1056 |
| 4 | 350 | 2.8 | 6.15 | 1 | 6.15 | 2154 | 233 | 1437 |
| 5 | 350 | 3.2 | 8.04 | 1 | 8.04 | 2813 | 233 | 1876 |
| 6 | 510 | 1.6 | 2.01 | 1 | 2.01 | 1025 | 279 | 560 |
| 7 | 510 | 2.0 | 3.14 | 1 | 3.14 | 1601 | 279 | 875 |
| 8 | 510 | 2.4 | 4.52 | 1 | 4.52 | 2306 | 279 | 1260 |
| 9 | 510 | 2.8 | 6.15 | 1 | 6.15 | 3139 | 279 | 1715 |
| 10 | 510 | 3.2 | 8.04 | 1 | 8.04 | 4100 | 279 | 2240 |
| 11 | 350 | 1.6 | 2.01 | 2 | 4.02 | 1407 | 233 | 938 |
| 12 | 350 | 2.0 | 3.14 | 2 | 6.28 | 2198 | 233 | 1466 |
| 13 | 350 | 2.4 | 4.52 | 2 | 9.04 | 3165 | 233 | 2111 |
| 14 | 510 | 1.6 | 2.01 | 2 | 4.02 | 2050 | 279 | 1120 |
| 15 | 510 | 2.0 | 3.14 | 2 | 6.28 | 3203 | 279 | 1750 |
| 16 | 510 | 2.4 | 4.52 | 2 | 9.04 | 4612 | 279 | 2520 |

(56) References Cited

U.S. PATENT DOCUMENTS

| | | | | |
|---|---|---|---|---|
| 9,667,176 | B2 | 5/2017 | Ogawa | |
| 11,529,669 | B2 | 12/2022 | Mizuno et al. | |
| 11,554,409 | B2 | 1/2023 | Mizuno et al. | |
| 2009/0160373 | A1 | 6/2009 | Katou et al. | |
| 2009/0283167 | A1 | 11/2009 | Nakagawa et al. | |
| 2012/0160364 | A1 | 6/2012 | Katou et al. | |
| 2013/0112133 | A1 | 5/2013 | Asensio et al. | |
| 2013/0314007 | A1 | 11/2013 | Yanagihara et al. | |
| 2018/0202178 | A1 | 7/2018 | Shima et al. | |
| 2018/0207709 | A1 | 7/2018 | Kasahara et al. | |
| 2019/0193879 | A1 | 6/2019 | Yamamoto et al. | |
| 2020/0002963 | A1 | 1/2020 | Kawazoe | |
| 2021/0002911 | A1* | 1/2021 | Asakura | B21F 15/04 |
| 2021/0067065 | A1 | 3/2021 | Wang | |
| 2021/0178454 | A1 | 6/2021 | Mizuno et al. | |
| 2021/0180347 | A1 | 6/2021 | Mizuno et al. | |
| 2021/0245904 | A1* | 8/2021 | Itagaki | B65B 13/025 |
| 2021/0387246 | A1 | 12/2021 | Kasahara et al. | |

FOREIGN PATENT DOCUMENTS

| | | | | |
|---|---|---|---|---|
| DE | 102016124850 | A1 * | 6/2018 | B21F 15/02 |
| GB | 2047430 | B | 2/1983 | |
| JP | 2012526935 | A * | 1/2013 | E04G 21/123 |
| JP | 2017024752 | A | 2/2017 | |
| WO | WO-2010130984 | A1 * | 11/2010 | E04G 21/122 |

* cited by examiner

FIG. 18

| | Tensile Strength (MPa) | Wire Diameter (mm) | Cross-Sectional Area ($mm^2$) | Winding Count (times) | Overall Cross-Sectional Area ($mm^2$) | Overall Maximum Tensile Load (N) | Yield Stress (MPa) | Overall Yield-Point Load (N) |
|---|---|---|---|---|---|---|---|---|
| 1 | 520 | 0.8 | 0.50 | 4 | 2.01 | 1045 | 300 | 603 |
| 2 | 520 | 1.0 | 0.79 | 2 | 1.57 | 816 | 317 | 498 |

FIG. 19

| | Tensile Strength (MPa) | Wire Diameter (mm) | Cross-Sectional Area ($mm^2$) | Winding Count (times) | Overall Cross-Sectional Area ($mm^2$) | Overall Maximum Tensile Load (N) | Yield Stress (MPa) | Overall Yield-Point Load (N) |
|---|---|---|---|---|---|---|---|---|
| 1 | 350 | 1.6 | 2.01 | 1 | 2.01 | 703 | 233 | 469 |
| 2 | 350 | 2.0 | 3.14 | 1 | 3.14 | 1099 | 233 | 733 |
| 3 | 350 | 2.4 | 4.52 | 1 | 4.52 | 1583 | 233 | 1056 |
| 4 | 350 | 2.8 | 6.15 | 1 | 6.15 | 2154 | 233 | 1437 |
| 5 | 350 | 3.2 | 8.04 | 1 | 8.04 | 2813 | 233 | 1876 |
| 6 | 510 | 1.6 | 2.01 | 1 | 2.01 | 1025 | 279 | 560 |
| 7 | 510 | 2.0 | 3.14 | 1 | 3.14 | 1601 | 279 | 875 |
| 8 | 510 | 2.4 | 4.52 | 1 | 4.52 | 2306 | 279 | 1260 |
| 9 | 510 | 2.8 | 6.15 | 1 | 6.15 | 3139 | 279 | 1715 |
| 10 | 510 | 3.2 | 8.04 | 1 | 8.04 | 4100 | 279 | 2240 |
| 11 | 350 | 1.6 | 2.01 | 2 | 4.02 | 1407 | 233 | 938 |
| 12 | 350 | 2.0 | 3.14 | 2 | 6.28 | 2198 | 233 | 1466 |
| 13 | 350 | 2.4 | 4.52 | 2 | 9.04 | 3165 | 233 | 2111 |
| 14 | 510 | 1.6 | 2.01 | 2 | 4.02 | 2050 | 279 | 1120 |
| 15 | 510 | 2.0 | 3.14 | 2 | 6.28 | 3203 | 279 | 1750 |
| 16 | 510 | 2.4 | 4.52 | 2 | 9.04 | 4612 | 279 | 2520 |

REBAR TYING TOOL

CROSS-REFERENCE TO RELATED APPLICATIONS

This application claims priority to Japanese patent application no. 2022-061997 filed on Apr. 1, 2022, and to Japanese patent application no. 2022-107137 filed on Jul. 1, 2022, the contents of which are fully incorporated herein by reference.

TECHNICAL FIELD

The disclosure of the present specification relates to a rebar tying tool, e.g., for use in tying together (binding) reinforcing bars used in reinforced concrete.

BACKGROUND ART

US 2018/207709 discloses a rebar tying tool (binding machine) that ties together (binds) reinforcing bars (hereinafter "rebars") using a wire. This rebar tying tool comprises: a reel comprising a bobbin and the wire, which is wound around the bobbin; a reel-holding part configured to hold the reel in a rotatable manner; a feeding part (feeding unit) configured to advance the wire from the reel around the rebars; and a twisting part (twisting unit) configured to twist the wire after it has been curled (wound, looped) around the rebars. The wire used with this known rebar tying tool is a steel wire having a diameter of approximately 1 mm.

SUMMARY OF THE INVENTION

It is one non-limiting object of the present teachings to disclose techniques for tying together rebars more tightly.

Embodiments of rebar tying tools disclosed herein are configured to tie together (bind) rebars using a wire, e.g., for use in reinforcing concrete. Such rebar tying tools may comprise: a reel comprising a bobbin and the wire, which is wound on the bobbin; a reel-holding part configured to hold the reel in a rotatable manner; a feed part (feed mechanism) configured to advance the wire from the reel around the rebars (preferably by a predetermine number of turns or windings around the rebar; and a twisting part (twisting mechanism) configured to twist (terminal ends of) the wire that is around the rebars (i.e. after the wire has been looped (wound) around two or more rebars).

In one aspect of the present disclosure, the overall (total) maximum tensile load of the wire looped around the rebars (i.e. the wire wound on the bobbin) may be 1,050 N or more. The overall (total) maximum tensile load is calculated by multiplying the maximum tensile load of the wire by the number of turns of the wire around the rebars.

To tightly tie together (bind) the rebars, it is necessary to twist terminal ends of the wire that is curled or looped around two or more rebars with a strong force. However, if the overall maximum tensile load of the wire, which is looped around the rebars, is small (low), when the terminal ends of the looped wire are twisted with a strong force, there is a risk that the wire will fracture (break). On the other hand, if the overall maximum tensile load of the wire around the rebars is 1,050 N or more, even if the terminal ends of the wire that is looped around the rebars are twisted with a strong force, it is possible to reduce the likelihood of fracturing of the wire. Thus, by utilizing a wire that will have an overall maximum tensile load of at least 1,050 N after the predetermined number of turns of the wire have been wound around the rebars, the rebars can be tied more tightly.

In addition or in the alternative, in another aspect of the present teachings, the maximum tensile load per single wire looped around the rebars (i.e. the wire wound on the bobbin) may be 700 N or more.

As was mentioned above, to tightly tie together the rebars, it is necessary to twist the terminal ends of the wire that is curled or looped around the rebars with a strong force. However, if the maximum tensile load per single (each) wire looped or curled around the rebars (i.e. the wire wound on the bobbin) is small (low), when the terminal ends of the single looped wire are twisted with a strong force, there is a risk that the wire will fracture (break). On the other hand, if the maximum tensile load per single wire around the rebars is 700 N or more (i.e. if the wire wound on the bobbin has a maximum tensile load of at least 700 N), even if the terminal ends of the wire that is looped around the rebars are twisted with a strong force, it is possible to reduce the likelihood of fracturing of the wire. Thus, if a wire having a maximum tensile load of at least 700 N is wound on the bobbin and used to tie together the rebars, the rebars can be tied together more tightly.

In addition or in the alternative, in another aspect of the present teachings, the overall (total) yield-point load of the wire looped around the rebars (i.e. the wire wound on the bobbin) may be 700 N or more. The overall (total) yield-point load is calculated by multiplying the yield-point load of the wire by the number of turns of the wire around the rebars.

If the wire that ties together the rebars deforms in an adverse manner during the advancing or twisting process, one or more gaps might form between the rebars and the wire, and thereby the tying of the rebars will loosen in an adverse manner. Consequently, to tightly tie together the rebars, it is necessary to reduce the likelihood that the wire that ties together the rebars will adversely deform during the advancing or twisting process. If the overall yield-point load of the wire looped around the rebars by the predetermined number of turns is small (low) and a strong force acts on the terminal ends of the looped wire, there is a risk that the wire will deform in an adverse manner. On the other hand, if the overall yield-point load of the wire looped around the rebars by the predetermined number of turns is 700 N or more, even if a strong force acts on the wire that ties the rebars, it is possible to reduce the likelihood of adverse deformation of the wire. In this aspect as well, the rebars can be tied together more tightly.

In addition or in the alternative, in another aspect of the present teachings, the yield-point load per single wire looped around the rebars (i.e. the wire wound on the bobbin) may be 450 N or more.

As was mentioned above, if the wire that ties together the rebars deforms in an adverse manner during the advancing or twisting process, one or more gaps might form between the rebars and the wire, and therefore the tying of the rebars will loosen in an adverse manner. Consequently, to tie the rebars tightly, it is necessary to reduce the likelihood that the wire that ties together the rebars will adversely deform during the advancing or twisting process. If the yield-point load per single wire looped around the rebars (i.e. the wire wound on the bobbin) is small (low) and a strong force acts on the looped wire, then there is a risk that the wire will deform in an adverse manner. On the other hand, if the yield-point load per single wire looped around the rebars (i.e. the wire wound on the bobbin) is 450 N or more, even if a strong force acts on the wire that ties together the rebars, it is possible to reduce the likelihood of adverse deformation of the wire. In this aspect as well, the rebars can be tied more tightly.

BRIEF DESCRIPTION OF THE DRAWINGS

FIG. 18 is a table that concerns wires W used by a rebar tying tool according to a comparative example.

FIG. 19 is a table that concerns wires W used by the rebar tying tool 2 according to the working example.

DETAILED DESCRIPTION OF THE EMBODIMENTS

Figure 1:
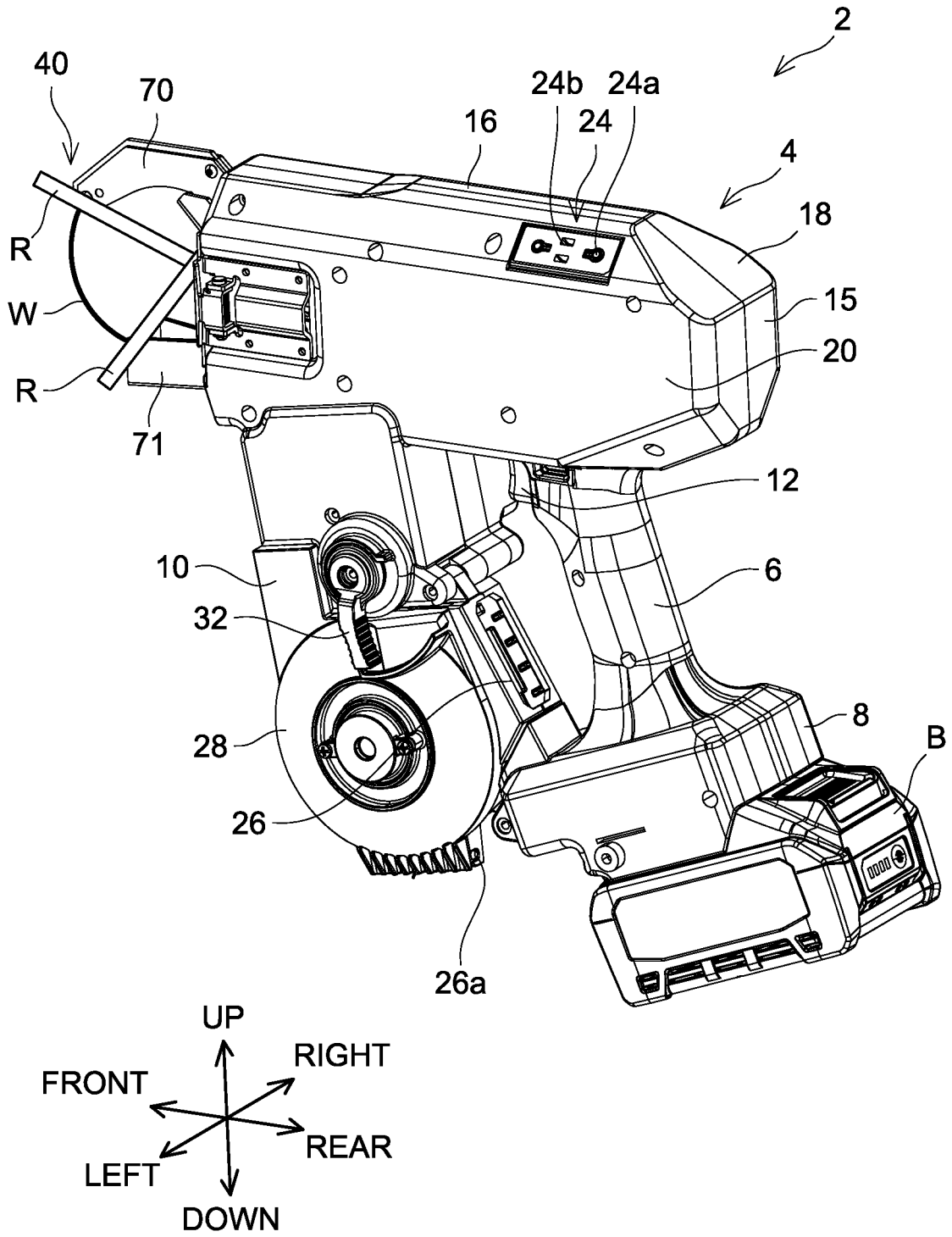
FIG. 1 is an oblique view, viewed from the rear, the left, and above, of a rebar tying tool 2 according to a working example.

Representative, non-limiting concrete examples of the present invention are explained in detail below, with reference to the drawings. This detailed explanation is intended merely to illustrate to a person skilled in the art that details to implement preferred examples of the present invention are not intended to limit the scope of the present invention. In addition, additional features and the invention disclosed below can be used separately from or together with other features and inventions to provide additional improved rebar tying tools, manufacturing methods, and methods of use.

In addition, the combinations of features and processes disclosed in the detailed explanation below are not essential to carry out the present invention in the broadest meaning and are recited only to explain representative concrete examples of the present invention in particular. Furthermore, in providing additional and useful embodiments of the present invention, the various features of the representative concrete examples above and below and the various features of the independent and dependent claims do not necessarily have to be combined as indicated in the concrete examples recited herein or as indicated in the sequence enumerated herein.

All features recited in the present specification and/or in the patent claims are intended, separately from the configuration of features recited in the working examples and/or the claims, to be disclosed individually and mutually independently as limitations relative to the specific matters disclosed in the disclosure and claims of the original patent application. Furthermore, description related to all numerical ranges, groups, and collections are intended to disclose intermediate configurations thereof as limitations relative to specific matters recited in the disclosure and the claims of the original patent application.

As was mentioned above, embodiments of rebar tying tools disclosed herein are configured tie together (bind) rebars using a wire, e.g., for use in reinforcing concrete. Such rebar tying tools may preferably comprise one or more of: a reel comprising a bobbin and the wire, which is wound on the bobbin; a reel-holding part configured to hold the reel in a rotatable manner; a feed part (feed mechanism) configured to advance the wire from the reel by a predetermined number of turns around the rebars; and a twisting part (twisting mechanism) configured to twist (terminal ends of) the wire after the predetermined number of turns have been wound around the rebars (i.e. after the wire has been looped around two or more rebars). Preferably, the overall (total) maximum tensile load of the wire looped around the rebars (i.e. the wire wound on the bobbin) may be 1,050 N or more, wherein the overall (total) maximum tensile load of the wire is calculated by multiplying the maximum tensile load of the wire by the predetermined number of turns of the wire that have been wound around the rebars. For example, the predetermined number of turns of the wire are preferably one or two, although the predetermined number of turns may be three or greater.

In one or more embodiments, the overall maximum tensile load of the wire after having been wound (looped) around the rebars by the predetermined number of turns may be within the range of 1,050-4,700 N.

Generally speaking, to increase the overall maximum tensile load of the wire around the rebars, it is necessary to increase the number (i.e. the number of turns or winding count) and/or the diameter of the wires. However, if the number of turns and/or the diameter of the wires is/are excessively large, then there is a risk that an excessive load will act on the motive-power source (e.g., an electric motor) that drives the twisting part. By utilizing a wire such that an overall maximum tensile load of at least 1,050 N will be achieved when the wire has been wound around the rebars by the predetermined number of turns, the rebars can be tied together more tightly (without breaking the wire) while reducing the likelihood that an excessive load will act on the motive-power source that drives the twisting part.

Preferably, the overall yield-point load of the wire wound (looped) around the rebars after the wire has been wound around the rebars by the predetermined number of turns may be 700 N or more, wherein the overall (total) yield-point load of the wire is calculated by multiplying the maximum yield-point load of the wire by the predetermined number of turns of the wire that have been wound around the rebars. For example, the predetermined number of turns of the wire are preferably one or two, although the predetermined number of turns may be three or greater.

In one or more embodiments, the overall yield-point load of the wire wound (looped) around the rebars after the wire has been wound the predetermined number of times around the rebars may be within the range of 700-2,550 N.

Generally speaking, when the overall yield-point load of the wire around the rebars is excessively large, the wire tends not to tightly contact the outer-circumferential surfaces of the rebars after the advancing and/or twisting operations, and thereby one or more gaps can adversely form between the wire and the rebars. In this case, it becomes difficult to tightly tie together the rebars. However, by suitably selecting the overall yield-point load of the wire within the above-noted range (e.g., by appropriately selecting the yield-point load of the wire wound on the bobbin and the predetermined number of turns of the wire around the rebars), the rebars can be tied together more tightly.

In one or more embodiments, the twisting part (mechanism) may comprise a tip-holding part configured to hold a tip of the wire that has advanced around the rebars. The feed part (mechanism) may be configured to draw back (pull, tension) the wire after the tip-holding part holds the tip of the wire and before the twisting part twists the wire (i.e. the terminal ends of the wire looped around two or more rebars).

According to the above-mentioned configuration, because the feed part draws back the wire, when the twisting part twists the wire, the wire can be twisted from a state in which the wire has been brought into tighter contact with the rebars. By employing such a configuration, the rebars can be tied together more tightly.

In one or more embodiments, the diameter of the wire may be 1.6 mm or more. Although the upper limit of the diameter of the wire is not particularly limited, the diameter of the wire may be, e.g., 5 mm or less, e.g., 4 mm or less when the predetermined number of turns is one and may be, e.g., 2.5 mm or less, e.g., 2.3 mm or less when the predetermined number of turns is two.

Such a wire enables the rebars to be tied together more tightly.

In one or more embodiments, the diameter of a trunk part of the bobbin may be 50 mm or more. Although the upper limit of the diameter of the trunk part is not particularly limited, the diameter of the trunk part may be, e.g., 100 mm or less, e.g., 80 mm or less.

By making the diameter of the trunk part of the bobbin relatively large (i.e. at least 50 mm), it is possible to reduce the likelihood that a winding curl (curved plastic deformation) will be imparted to the wire due to the wire being wound on the bobbin.

In one or more embodiments, the feed part may comprise feed rollers, which advance the wire by rotating. The hardness of the feed rollers may be 56 HRC or more. Although the upper limit of the hardness of the feed rollers is not particularly limited, the hardness of the feed rollers may be, e.g., 70 HRC or less, e.g., 68 HRC or less.

According to the above-mentioned configuration, it is possible to reduce the likelihood and/or amount of adverse wear on the feed rollers when the feed part advances the wire.

In one or more embodiments, the rebar tying tool may further comprise a cutting part comprising cutters configured to cut the wire after the wire has been looped around two or more rebars. The hardness of the cutters may be 56 HRC or more. Although the upper limit of the hardness of the cutters is not particularly limited, the hardness of the cutters may be, e.g., 70 HRC or less, e.g., 68 HRC or less.

According to the above-mentioned configuration, it is possible to reduce the likelihood and/or amount of adverse wear on the cutters when the cutting part cuts the wire.

In one or more embodiments, the rebar tying tool may further comprise a grip (handle), which the user grips (grasps, hold) during a rebar tying operation so that the user can perform the work of tying together the rebars in a hand-held state.

According to the above-mentioned configuration, the rebars can be tied more tightly by using the hand-held-type rebar tying tool.

Preferably, the maximum tensile load per single wire looped around the rebars (i.e. the wire wound on the bobbin) may be 700 N or more.

Preferably, the yield-point load per single wire looped around the rebars (i.e. the wire wound on the bobbin) may be 450 N or more.

Working Example

The rebar tying tool 2 shown in FIG. 1 is configured to tie together (bind) a plurality of rebars (reinforcing bars) R using a wire W. The rebar tying tool 2 comprises a main body 4, a grip (handle) 6, a battery-mount part 8, a battery pack (battery cartridge) B, and a reel holder 10. The grip 6 is configured to be gripped by the user. The grip 6 is disposed at a rear-side lower portion of the main body 4. The grip 6 is formed integrally with the main body 4. A trigger 12 is provided at a front-surface upper portion of the grip 6. A trigger switch 14 (refer to FIG. 3), which detects whether the trigger 12 is being pulled, is disposed in the interior of the grip 6. The battery-mount part 8 is disposed at a lower portion of the grip 6. The battery-mount part 8 is formed integrally with the grip 6. The battery pack B is detachable by being slid relative to the battery-mount part 8. The battery pack B preferably comprises a secondary (rechargeable) battery such as, for example, one or more lithium-ion battery cells. The reel holder 10 is disposed at a front-side lower portion of the main body 4. The reel holder 10 is disposed forward of the grip 6. It is noted that, in the present working example, a longitudinal direction of a twisting part 46, which is described below, is called the front-rear direction, a direction orthogonal to the front-rear direction is called an up-down direction, and a direction orthogonal to the front-rear direction and the up-down direction is called a left-right direction, as can be seen in the directional notations in the appended drawings.

Figure 2:
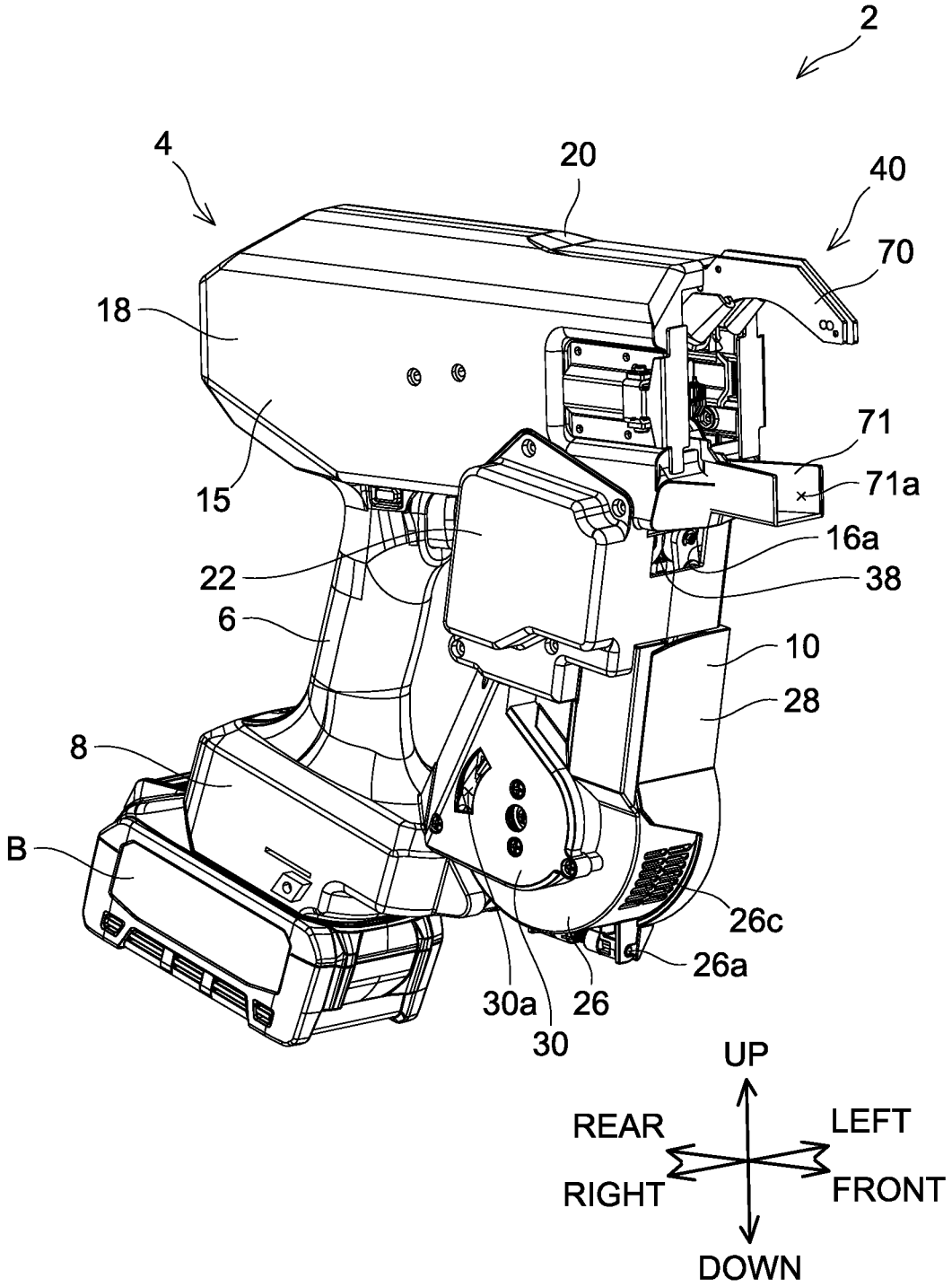
FIG. 2 is an oblique view, viewed from the front, the right, and above, of the rebar tying tool 2 according to the working example.

The rebar tying tool 2 comprises a housing 16. The housing 16 constitutes a portion of a support part 15. As shown in FIG. 2, the housing 16 comprises a right housing half 18, a left housing half 20, and a motor cover 22. The right housing half 18 defines the shape of the right-half surfaces of the main body 4, the grip 6, and the battery-mount part 8. The left housing half 20 defines the shape of the left-half surfaces of the main body 4, the grip 6, and the battery-mount part 8. The motor cover 22 is mounted on the outer side of the right housing half 18. As shown in FIG. 1, an operation-and-display part 24 is disposed at (on) a rear-side upper portion of the left housing half 20. The operation-and-display part 24 comprises a main power-supply switch (e.g., a button switch) 24*a* and a main power-supply LED 24*b*. When the main power-supply switch 24*a* is manipulated (e.g., pressed) by the user, a main power supply of the rebar tying tool 2 is switched from ON to OFF or vice versa. The main power-supply LED 24*b* indicates the ON/OFF state of the main power supply of the rebar tying tool 2.

As shown in FIG. 2, the reel holder 10 comprises a holder housing 26, a main cover 28, and an auxiliary cover 30. The holder housing 26 and the auxiliary cover 30 constitute a portion of the support part 15. The holder housing 26 is fixed to a front-side lower portion of the main body 4 and a front portion of the battery-mount part 8. The left end of the holder housing 26 is open. The main cover 28 is mounted on the holder housing 26 so as to be rotatable about a pivot shaft 26*a* of the holder housing 26 at the lower portion of the holder housing 26. The main cover 28 is biased in the open direction by a torsion spring 31 (refer to FIG. 3). A closed-state detection sensor (not shown), which detects whether the main cover 28 is in the closed state, is mounted on the holder housing 26. The auxiliary cover 30 covers the right surface of the holder housing 26. The auxiliary cover 30 demarcates (bounds) an auxiliary space 30*a*, which is between the auxiliary cover 30 and the right surface of the holder housing 26.

As shown in FIG. 1, a lock lever 32, which is for retaining the main cover 28 in the closed state, is disposed at (on) a front-side lower portion of the left housing half 20. When the lock lever 32 is pivoted, the main cover 28 opens relative to the holder housing 26 owing to the biasing force of the torsion spring 31 (refer to FIG. 3). In the state in which the main cover 28 is closed, a housing space 26*b* (refer to FIG. 3) is demarcated (bounded) by the holder housing 26 and the main cover 28. A reel 33 (refer to FIG. 3), which comprises the wire W in a wound state, is disposed in the housing space 26*b*. As shown in FIG. 2, a hole 26*c* is formed in the front surface of the holder housing 26. The user can visually assess (confirm) the remaining amount of the wire W on the reel 33 by looking at the reel 33 through the hole 26*c*.

Figure 3:
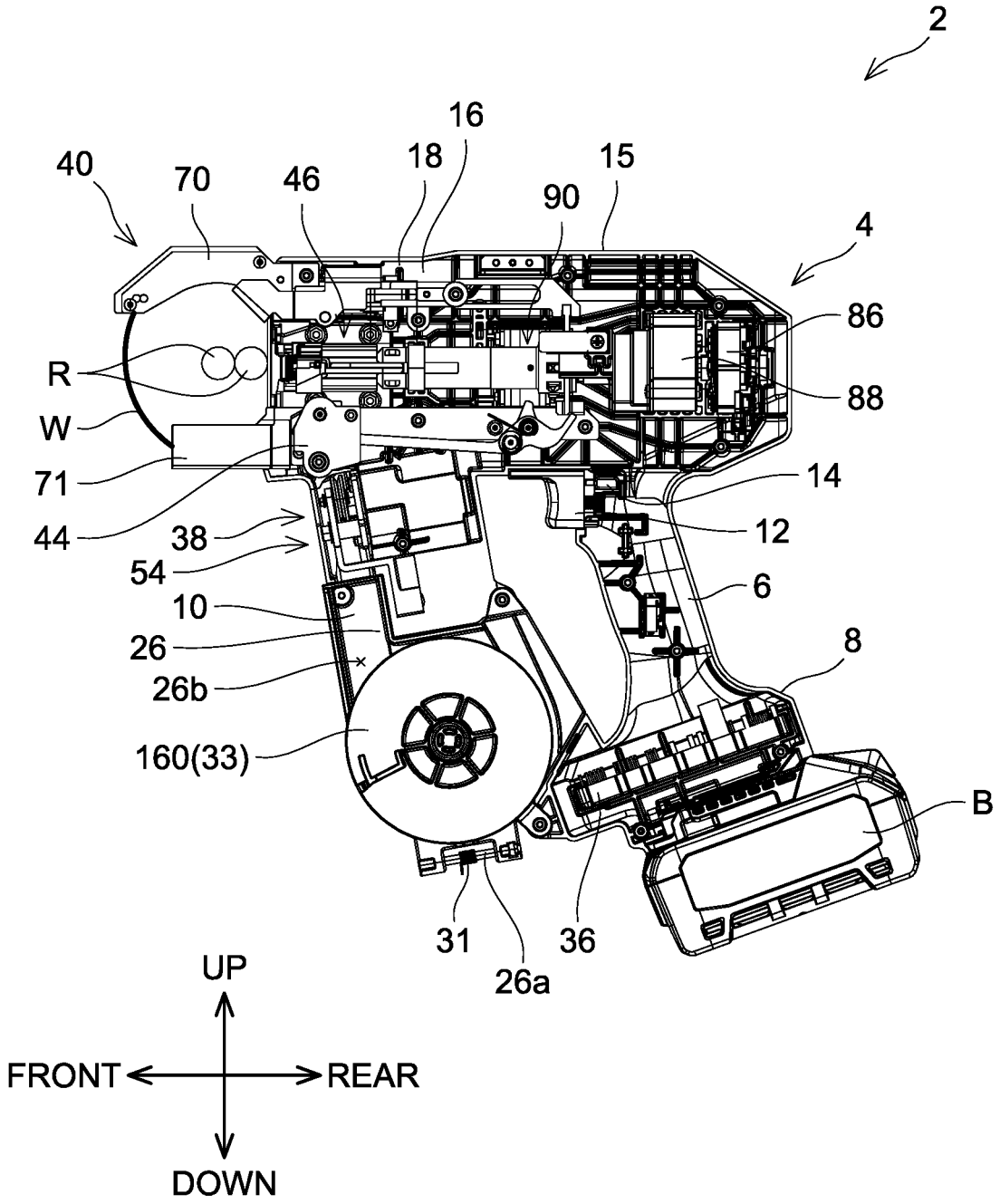
FIG. 3 is a side view that shows the internal configuration of the rebar tying tool 2 according to the working example.

As shown in FIG. 3, the rebar tying tool 2 comprises a control circuit board 36. The control circuit board 36 is disposed in the interior of the battery-mount part 8. The control circuit board 36 is electrically connected by wiring (not shown) respectively to the battery pack B, the trigger switch 14, and the operation-and-display part 24. In addition, the control circuit board 36 is electrically connected by wiring (not shown) to the closed-state detection sensor (not shown) mounted on the holder housing 26.

The rebar tying tool 2 comprises a feed part (feed mechanism) 38, a guide part (wire guide) 40, a cutting part (cutter or cutting mechanism) 44, and the twisting part (twisting mechanism) 46. The feed part 38 is disposed in the interior of a front-side lower portion of the main body 4. The guide part 40 is disposed at a front portion of the main body 4. The cutting part 44 is disposed in the interior of a lower portion of the main body 4. The twisting part 46 is disposed in the interior of the main body 4.

Configuration of Feed Part 38

Figure 4:
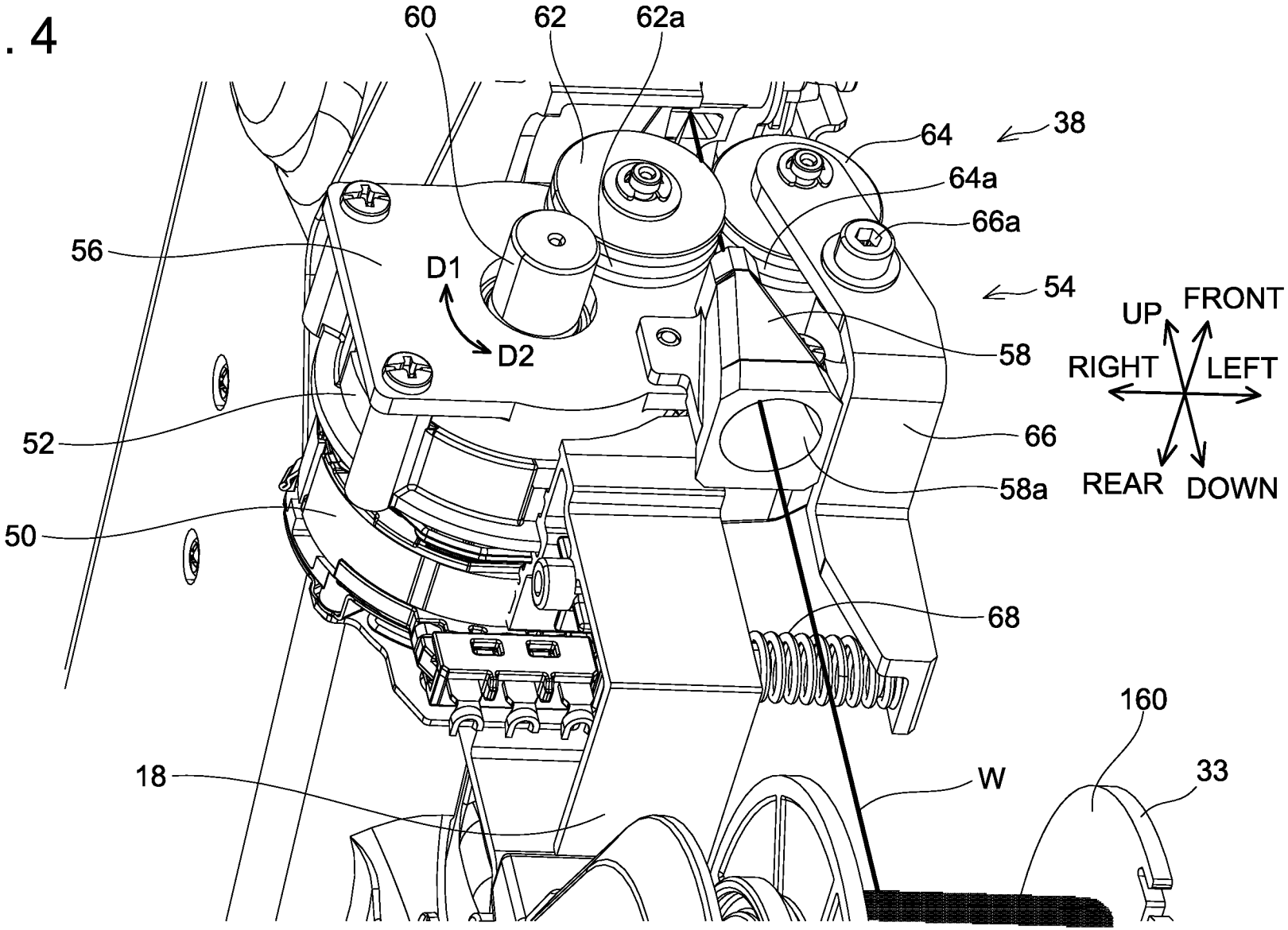
FIG. 4 is an oblique view of a feed part 38 according to the working example.

As shown in FIG. 4, the feed part 38 comprises a feed motor (i.e. a motor that supplies motive power for moving (advancing and retracting) the wire W) 50, a speed-reducing part (gear transmission) 52, and a feed unit 54. The feed motor 50 is, for example, a brushless DC motor. The feed motor 50 is disposed rightward of the right housing half 18 (refer to FIG. 2) and is covered by the motor cover 22 (refer to FIG. 2). The feed motor 50 is electrically connected by wiring (not shown) to the control circuit board 36. The feed motor 50 operates using electric power supplied from the battery pack B (refer to FIG. 2). The feed part 38 is configured to perform an advancing operation/process (a reeling-out or unreeling operation), which advances (reels out) the wire W to the guide part 40, and a draw-back operation (a pull back or retraction (reeling in) operation), which draws back (reels in) the wire W from the guide part 40, as will be further described below.

The speed-reducing part 52 comprises, for example, a planetary-gear mechanism. The speed-reducing part 52 reduces the speed of the rotation of the feed motor 50. In other words, the speed-reducing part is configured to convert the rotational output from the feed motor 50 into a rotational output having a lower rotational speed but higher torque than the rotational output from the feed motor 50.

Figure 5:
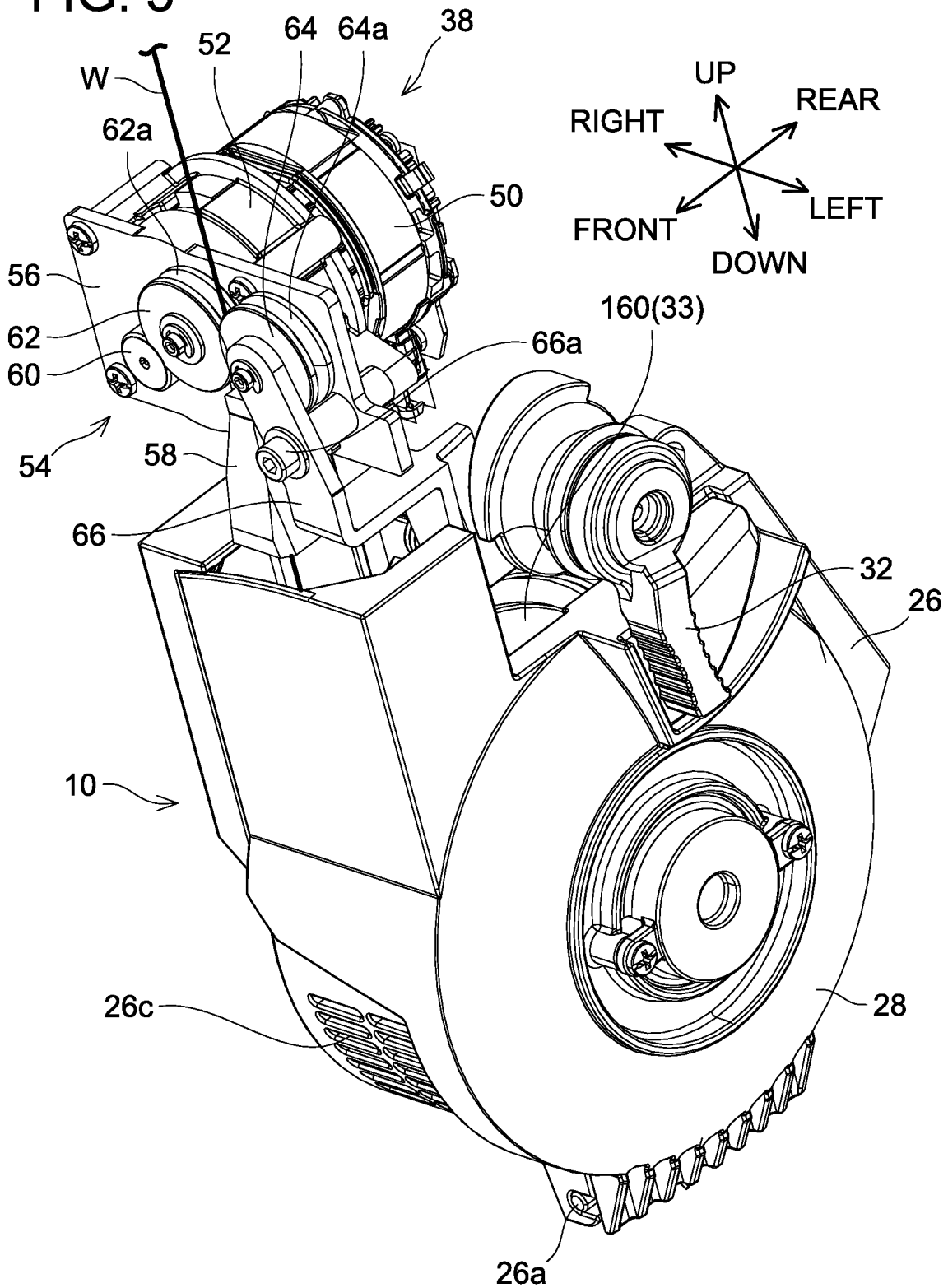
FIG. 5 is an oblique view of the feed part 38 and a reel holder 10 according to the working example.
Figure 6:
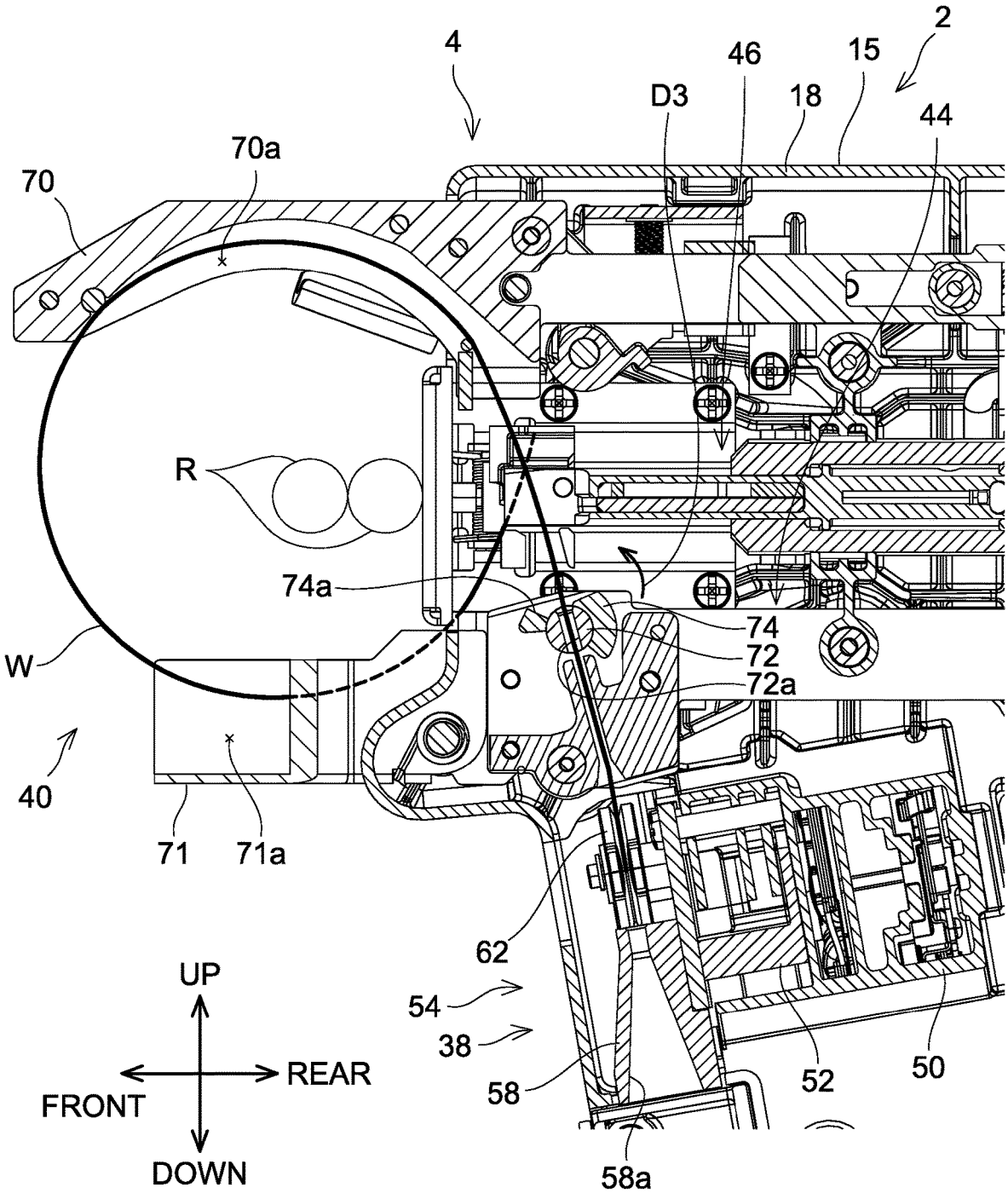
FIG. 6 is a cross-sectional view of the vicinity of a front-side upper portion of the rebar tying tool 2 according to the working example.

Referring to FIGS. 4-6, the feed unit 54 comprises a base member 56, a guide member (e.g., a funnel) 58, a drive gear 60, a first feed gear 62, a second feed gear 64, a release lever 66, and a compression spring (biasing member) 68. The guide member 58 is fixed to the base member 56. The guide member 58 has a guide hole 58*a*. The guide hole 58*a* has a tapered shape in which a lower-end portion is wide and an upper-end portion is narrow. The wire W passes through the guide hole 58*a*.

Rotation is transmitted from the speed-reducing part 52 to the drive gear 60. The first feed gear 62 is supported on (by) the base member 56 in a rotatable manner. The first feed gear 62 meshes with the drive gear 60. Rotation of the drive gear 60 causes the first feed gear 62 to rotate. The first feed gear 62 has a groove 62*a* configured to receive a first circumferential half (semi-circle) of the wire W. The groove 62*a* is formed on the outer-circumferential surface of the first feed gear 62 in a direction along the rotational direction of the first feed gear 62. The second feed gear 64 meshes with the first feed gear 62. The second feed gear 64 is supported on (by) the release lever 66 in a rotatable manner. The second feed gear 64 has a groove 64*a* configured to receive a second circumferential half (semi-circle) of the wire W. The groove 64*a* is formed on the outer-circumferential surface of the second feed gear 64 in a direction along the rotational direction of the second feed gear 64. The release lever 66 is supported on the base member 56 so as to be swingable (pivotable) about a pivot shaft 66*a*. The compression spring 68 biases (urges) the release lever 66 relative to the right housing half 18 (refer to FIG. 2) in the direction in which the second feed gear 64 approaches the first feed gear 62. Therefore, the second feed gear 64 is normally pressed toward (against) the first feed gear 62 by the compression spring 68. In this state, the wire W is elastically sandwiched (pressed, clamped) between the groove 62*a* of the first feed gear 62 and the groove 64*a* of the second feed gear 64. As shown in FIG. 5, when the lock lever 32 pivots in the direction that will release the retention of the main cover 28, the lower end of the release lever 66 is pressed in by the lock lever 32 and moves toward the right housing half 18. Thereby, the second feed gear 64 separates (moves away) from the first feed gear 62. In this state, the user can place the wire W of the reel 33 (refer to FIG. 4) between the groove 62*a* of the first feed gear 62 and the groove 64*a* of the second feed gear 64. It is noted that, as shown in FIG. 2, a window 16*a*, through which the user can see the location where the first feed gear 62 and the second feed gear 64 mesh, is formed in the front surface of the left housing half 20 and the front surface of the motor cover 22.

As shown in FIG. 4, when the feed motor 50 causes the first feed gear 62 to rotate while the wire W is sandwiched (pressed, clamped) between the groove 62*a* of the first feed gear 62 and the groove 64*a* of the second feed gear 64, the wire W is moved either forward (wire advancing movement)

or rearward (wire retracting (pull back) movement). More specifically, in the present working example, when the rotor of the feed motor 50 forwardly rotates (i.e. the rotor rotates in a first rotational direction), the drive gear 60 rotates in direction D1, which is shown in FIG. 4, and the wire W advances from the reel 33 toward the guide part 40. On the other hand, when the feed motor 50 reversely rotates (i.e. the rotor rotates in a second rotational direction that is opposite of the first rotational direction), the drive gear 60 rotates in direction D2, which is shown in FIG. 4, and the wire W is drawn back (retracted) from the feed part 38 toward the reel 33.

Configuration of Guide Part 40 As shown in FIG. 6, the guide part 40 comprises an upper-side curl guide 70 and a lower-side curl guide 71. The upper-side curl guide 70 and the lower-side curl guide 71 are disposed at a front portion of the main body 4. The lower end of the upper-side curl guide 70 is open downward. Thereby, an upper-side wire passageway 70*a* is formed in the upper-side curl guide 70. The lower-side curl guide 71 is disposed downward of the upper-side curl guide 70. The upper end of the lower-side curl guide 71 is open upward. Thereby, a lower-side wire passageway 71*a* is formed in the lower-side curl guide 71.

The wire W fed from the feed part 38 (refer to FIG. 4) is fed (advanced) to the upper-side wire passageway 70*a*. The wire W then passes through the upper-side wire passageway 70*a* from the rear side toward the front side. At this time, a downward curl is imparted to the wire W, i.e. the wire W is bent or curved (curled) into a circular shape or a loop shape, as can be seen, e.g., in FIGS. 1 and 3, owing to contact with the curved surfaces of the upper-side curl guide 70. The wire W that has passed through the upper-side wire passageway 70*a* is fed into the lower-side wire passageway 71*a*. The wire W passes through the lower-side wire passageway 71*a* from the front side toward the rear side. Thereby, when the upper-side curl guide 70 and the lower-side curl guide 71 are positioned such that the rebars are disposed within the interior space defined thereby, the wire W can be wound (looped) around the rebars R by the rebar tying tools 2. As discussed above and below, the feed part 38 is configured to loop (wind) the wire W around the rebars R by a predetermined number of turns, such that the number of turns (winding count) of the wire around the rebars may be preferably, one or two, although three or more turns may be utilized in other embodiments of the present teachings.

Configuration of Cutting Part 44

Figure 7:
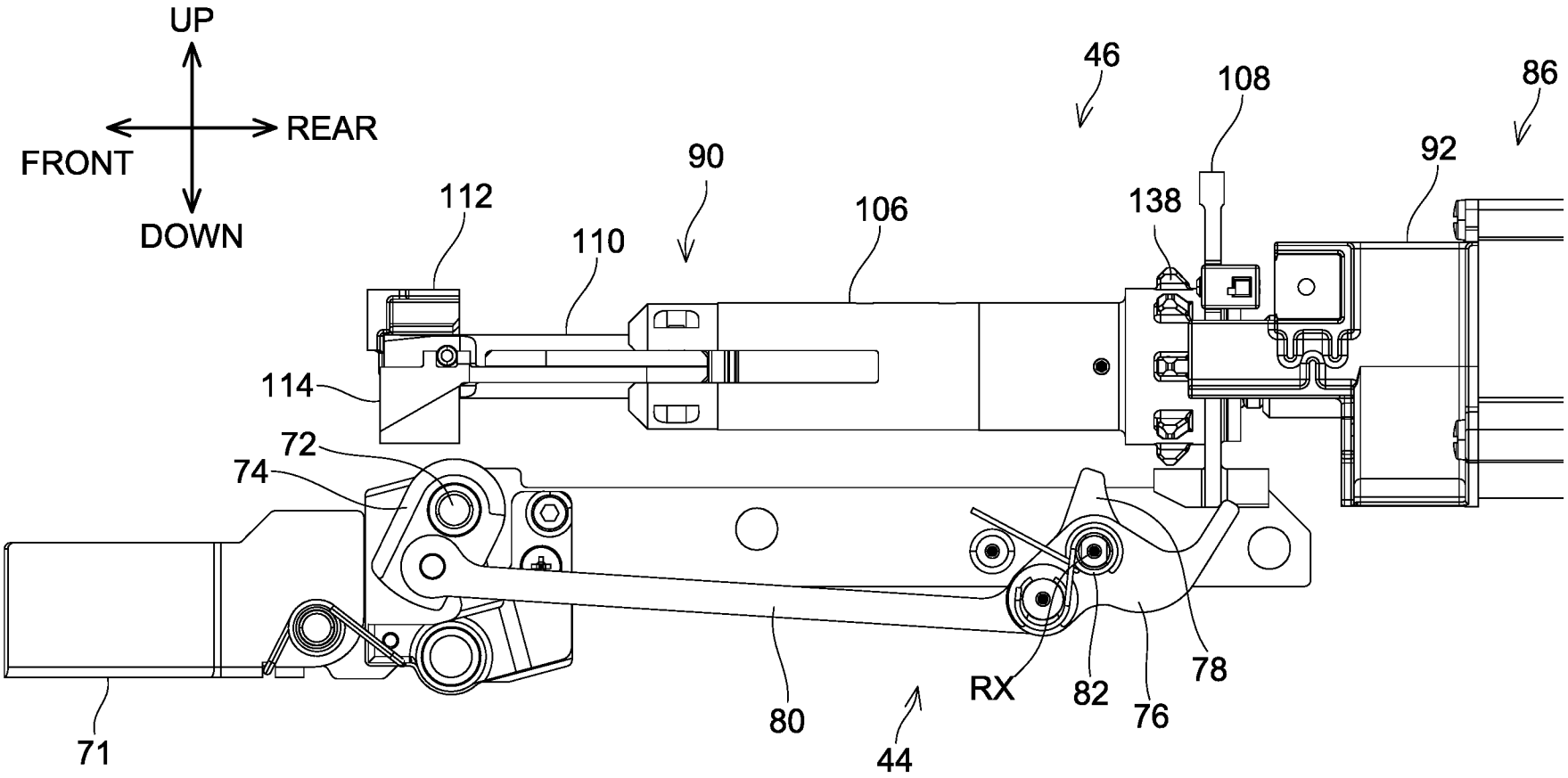
FIG. 7 is a side view that shows, in a cutting part 44 according to the working example, the state before a first lever member 76 and a second lever member 78 pivot.

As shown in FIG. 7, the cutting part (wire severing mechanism) 44 comprises a fixed-cutter member (fixed cutter or blade) 72, a movable-cutter member (movable cutter or blade) 74, a first lever member 76, a second lever member 78, a link member (link) 80, and a torsion spring 82. As shown in FIG. 6, the fixed-cutter member 72 and the movable-cutter member 74 are disposed along the passageway through which the wire W is fed from the feed part 38 toward the guide part 40. The fixed-cutter member 72 has a hole 72*a*, through which the wire W passes. The movable-cutter member 74 is supported on the fixed-cutter member 72 so as to be pivotable about and slidable on the fixed-cutter member 72. The movable-cutter member 74 has a hole 74*a* (see FIG. 6), through which the wire W passes. As shown in FIG. 6, in the state in which the hole 72*a* of the fixed-cutter member 72 and the hole 74*a* of the movable-cutter member 74 are in communication (hereinbelow, called the communicating state), the wire W can pass through the hole 72*a* of the fixed-cutter member 72 and the hole 74*a* of the movable-cutter member 74. Thereafter, when the movable-cutter member 74 pivots in direction D3 (shown in FIG. 6) relative to the fixed-cutter member 72 (hereinbelow, called the cutting state), the wire W is cut (severed) by the fixed-cutter member 72 and the movable-cutter member 74.

Figure 8:
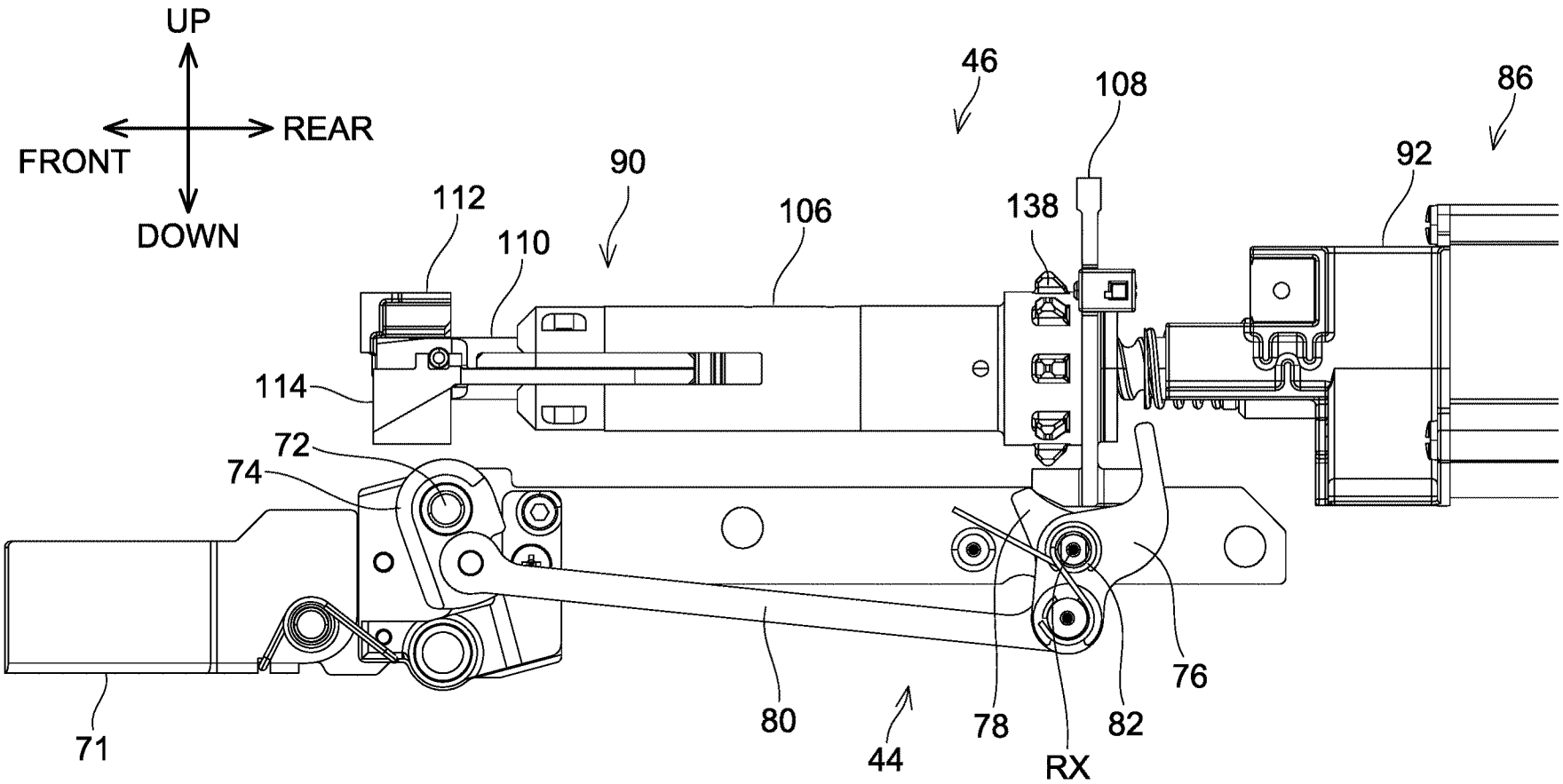
FIG. 8 is a side view that shows, in the cutting part 44 according to the working example, the state after the first lever member 76 and the second lever member 78 have pivoted.

As shown in FIG. 7, the first lever member 76 and the second lever member 78 are fixed to each other. The first lever member 76 and the second lever member 78 are swingable (pivotable) about axis RX. The lower end of the first lever member 76 and the lower end of the second lever member 78 are coupled to the rear end of the link member 80 in a pivotable manner. The front end of the link member 80 is coupled to the lower end of the movable-cutter member 74 in a pivotable manner. The rear end of the link member 80 is biased forward by the torsion spring 82. When the first lever member 76 and the lower end of the second lever member 78 swing in the forward direction, the link member 80 moves forward, and the fixed-cutter member 72 and the movable-cutter member 74 enter the communicating state. As shown in FIG. 8, when the first lever member 76 and the lower end of second lever member 78 swing in the rearward direction (pivot in the counterclockwise direction in the views shown in FIGS. 7 and 8), the link member 80 moves rearward, and the fixed-cutter member 72 and the movable-cutter member 74 enter the cutting state.

Configuration of Twisting Part 46

Figure 9:
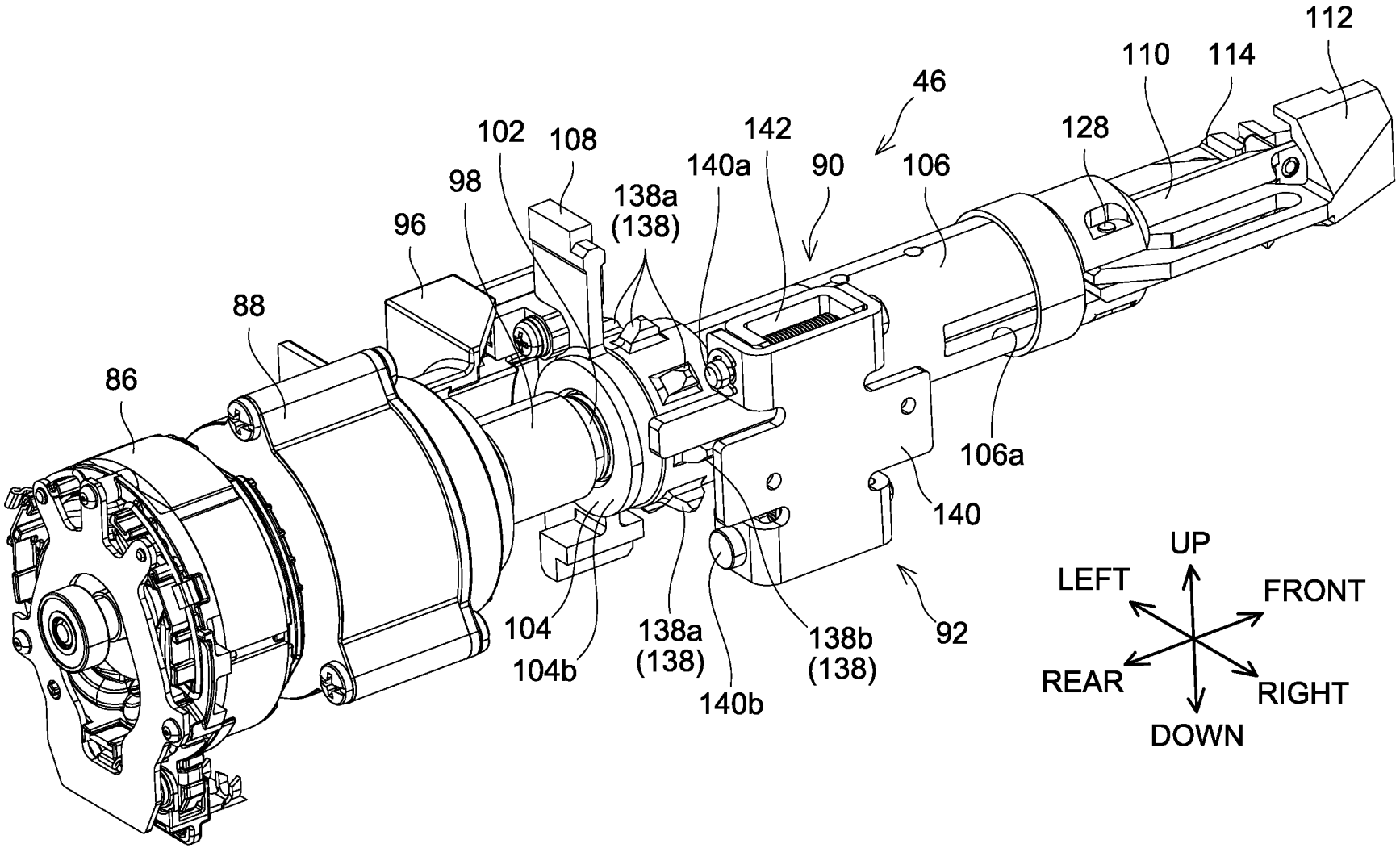
FIG. 9 is an oblique view of a twisting part 46 according to the working example.

As shown in FIG. 9, the twisting part 46 comprises a twisting motor 86 (i.e. a motor that supplies motive power for twisting together the two ends (terminal end portions) of a wire W that has been wound (looped) around the rebars R by the predetermined number of turns and then severed), a speed-reducing part (gear transmission) 88, a holding part (wire holding or clamping mechanism) 90, and a rotation-blocking part 92. The twisting motor 86 is, for example, a brushless DC motor. The twisting motor 86 is fixed to the right housing half 18 (refer to FIG. 1) and the left housing half 20 (refer to FIG. 1). The twisting motor 86 is electrically connected to the control circuit board 36 (refer to FIG. 3) by wiring (not shown). The twisting motor 86 operates using electric power supplied from the battery pack B (refer to FIG. 1).

The speed-reducing part 88 is fixed to the right housing half 18 and the left housing half 20. The speed-reducing part 88 comprises, for example, a planetary-gear mechanism. The speed-reducing part 88 reduces the speed of the rotation of the twisting motor 86. In other words, the speed-reducing part is configured to convert the rotational output from the twisting motor 86 into a rotational output having a lower rotational speed but higher torque than the rotational output from the twisting motor 86.

Figure 10:
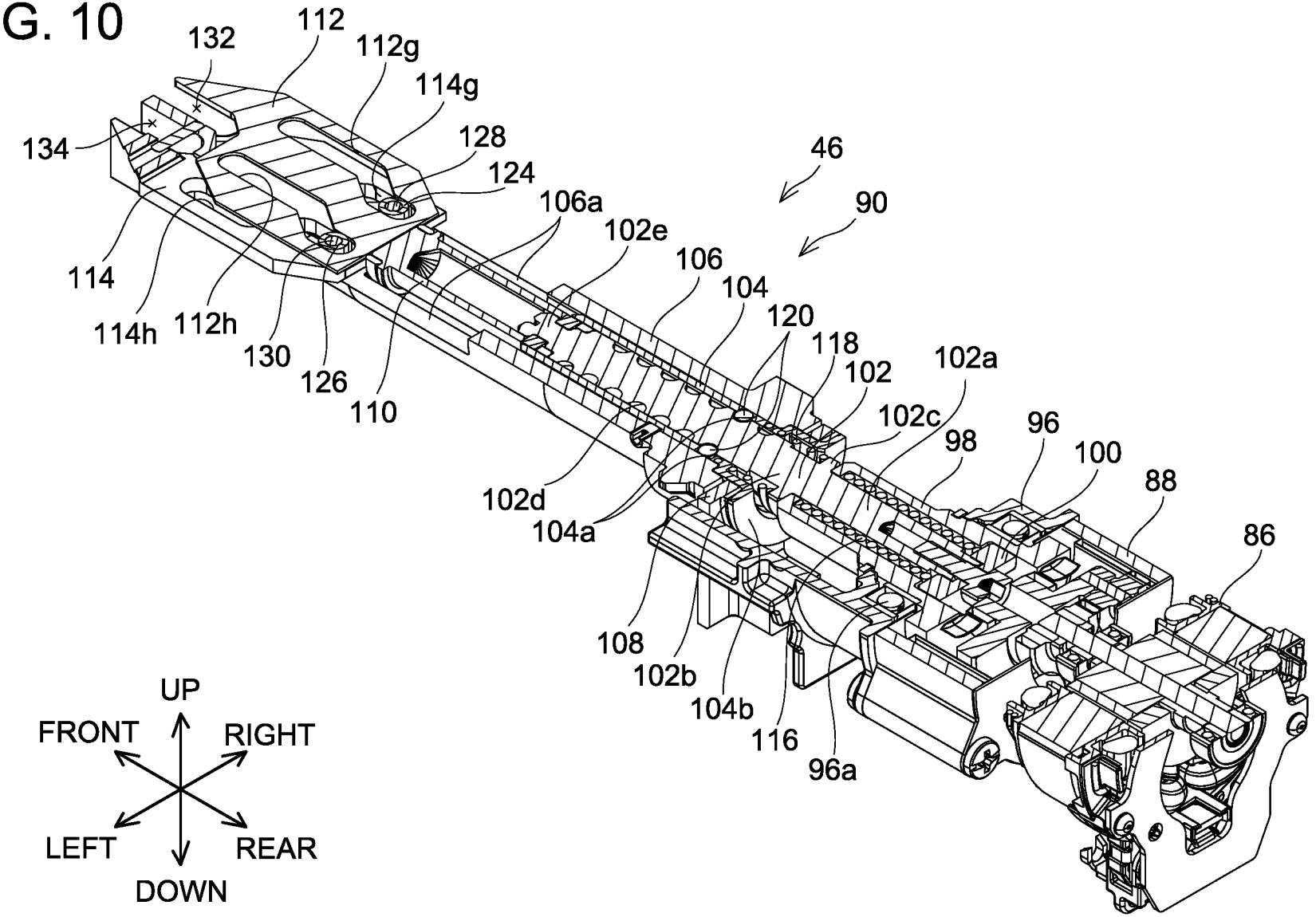
FIG. 10 is a cross-sectional view of a twisting motor 86, a speed-reducing part 88, and a holding part 90 according to the working example.

As shown in FIG. 10, the holding part 90 comprises a bearing box 96, a carrier sleeve 98, a clutch plate 100, a screw shaft 102, an inner sleeve 104, an outer sleeve 106, a push plate 108, a clamp shaft 110, a right clamp 112, and a left clamp 114.

The bearing box 96 is fixed to the speed-reducing part 88. The bearing box 96 supports the carrier sleeve 98 in a rotatable manner via a bearing 96*a*. Rotation from the speed-reducing part 88 is transmitted to the carrier sleeve 98. When the rotor of the twisting motor 86 forwardly rotates (rotates in a first rotational direction), the carrier sleeve 98 rotates in the direction of a left-hand screw, viewed from the rear side. When the twisting motor 86 reversely rotates (rotates in a second rotational direction that is opposite of the first rotational direction), the carrier sleeve 98 rotates in the direction of a right-hand screw, viewed from the rear side.

Figure 11:
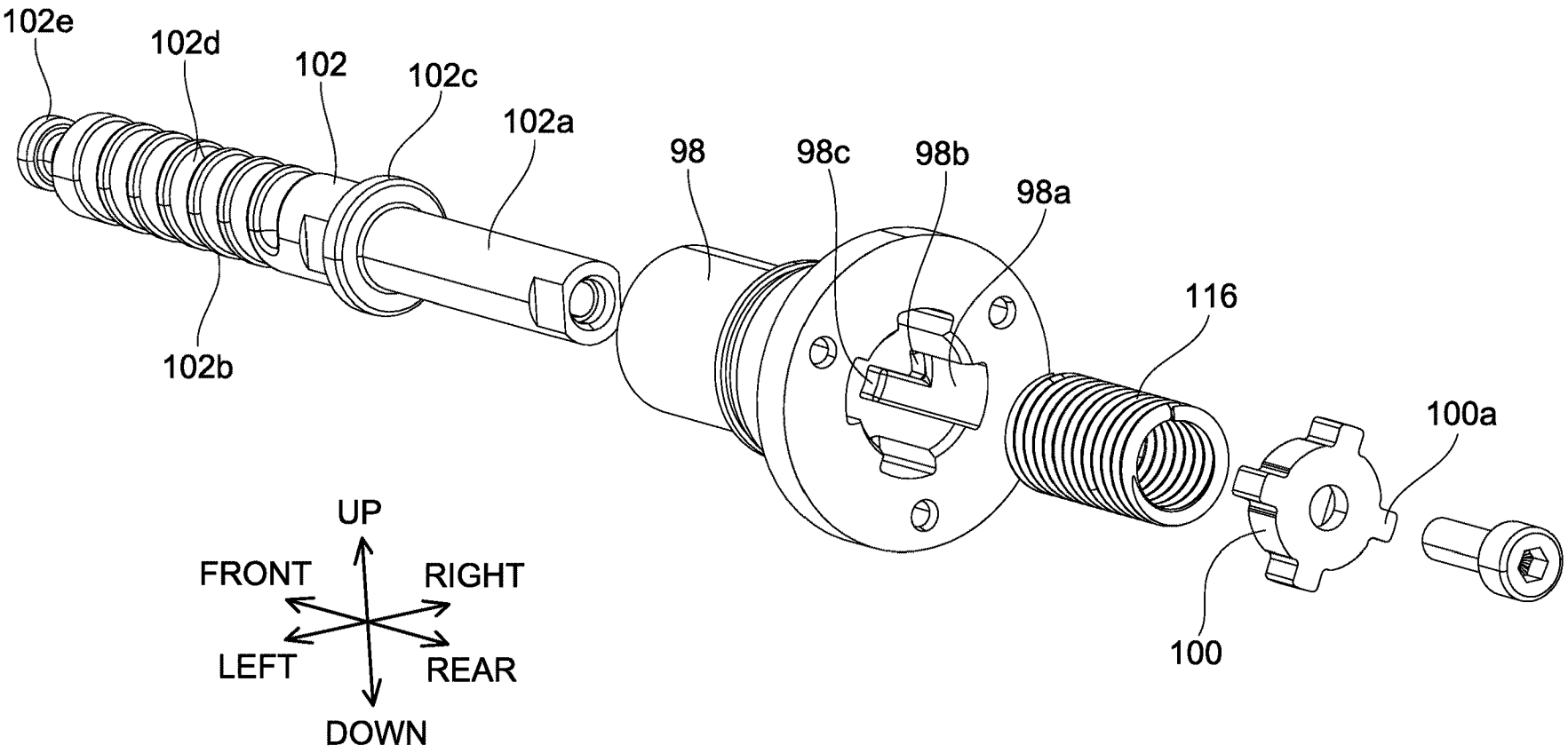
FIG. 11 is an exploded, oblique view of a carrier sleeve 98, a clutch plate 100, and a screw shaft 102 according to the working example.

As shown in FIG. 11, clutch grooves 98*a*, which extend in the front-rear direction, are formed on the inner surface of a rear portion of the carrier sleeve 98. A first wall part 98*b* and a second wall part 98*c* are formed at the front end of each of the clutch grooves 98*a*. The distance from the rear end of the carrier sleeve 98 to the first wall part 98*b* in the front-rear direction is smaller than the distance from the rear end of the carrier sleeve 98 to the second wall part 98*c* in the front-rear direction. The clutch plate 100 is disposed in the interior of the carrier sleeve 98. Clutch pieces 100*a* corresponding to the clutch grooves 98*a* are formed on the clutch plate 100. The clutch plate 100 is biased rearward relative to the carrier sleeve 98 by a compression spring 116, which is disposed in the interior of the carrier sleeve 98. The clutch plate 100 can advance relative to the carrier sleeve 98 to a position at which the clutch pieces 100*a* make contact with the first wall part 98*b* of each of the clutch grooves 98*a*. When the wire W is to be twisted, by rotating the carrier sleeve 98 relative to the clutch plate 100 in the direction of a left-hand screw viewed from the rear side, the clutch plate 100 can advance relative to the carrier sleeve 98 to the position at which the clutch pieces 100*a* make contact with the second wall part 98*c* of each of the clutch grooves 98*a*.

A rear part 102*a* of the screw shaft 102 is inserted into the carrier sleeve 98 from the front side and is fixed to the clutch plate 100. A flange 102*c*, which protrudes radially, is formed between the rear part 102*a* and a front part 102*b* of the screw shaft 102. A ball groove 102*d*, which has a helical shape, is formed on the outer-circumferential surface of the front part 102*b* of the screw shaft 102. An engaging part 102*e*, the diameter of which is smaller than that of the front part 102*b*, is formed at the front end of the screw shaft 102.

As shown in FIG. 10, a compression spring 118 is mounted on the front part 102*b* of the screw shaft 102. The front part 102*b* of the screw shaft 102 is inserted into the inner sleeve 104 from the rear side. Ball holes 104*a*, which hold balls 120, are formed in the inner sleeve 104. The balls 120 mate with the ball groove 102*d* of the screw shaft 102. A flange 104*b*, which protrudes radially, is formed at a rear end of the inner sleeve 104. The inner sleeve 104 is inserted into the outer sleeve 106 from the rear side. The outer sleeve 106 is fixed to the inner sleeve 104. In the state in which rotation of the outer sleeve 106 is permitted by the rotation-blocking part 92 (refer to FIG. 17), when the screw shaft 102 rotates, the inner sleeve 104 and the outer sleeve 106 rotate integrally. On the other hand, in the state in which rotation of the outer sleeve 106 is prohibited (blocked) by the rotation-blocking part 92, when the screw shaft 102 rotates, the inner sleeve 104 and the outer sleeve 106 move in the front-rear direction relative to the screw shaft 102. Specifically, when the rotor of the twisting motor 86 forwardly rotates and the screw shaft 102 rotates in the direction of a left-hand screw viewed from the rear side, the inner sleeve 104 and the outer sleeve 106 move forward relative to the screw shaft 102. On the other hand, when the twisting motor 86 reversely rotates and the screw shaft 102 rotates in the direction of a right-hand screw viewed from the rear side, the inner sleeve 104 and the outer sleeve 106 move rearward relative to the screw shaft 102. The push plate 108 is disposed between the rear end of the outer sleeve 106 and the flange 104*b* of the inner sleeve 104. Consequently, when the inner sleeve 104 and the outer sleeve 106 move in the front-rear direction, the push plate 108 also moves in the front-rear direction. Slits 106*a*, which extend rearward from the front end of the outer sleeve 106, are formed along a front portion of the outer sleeve 106.

Figure 12:
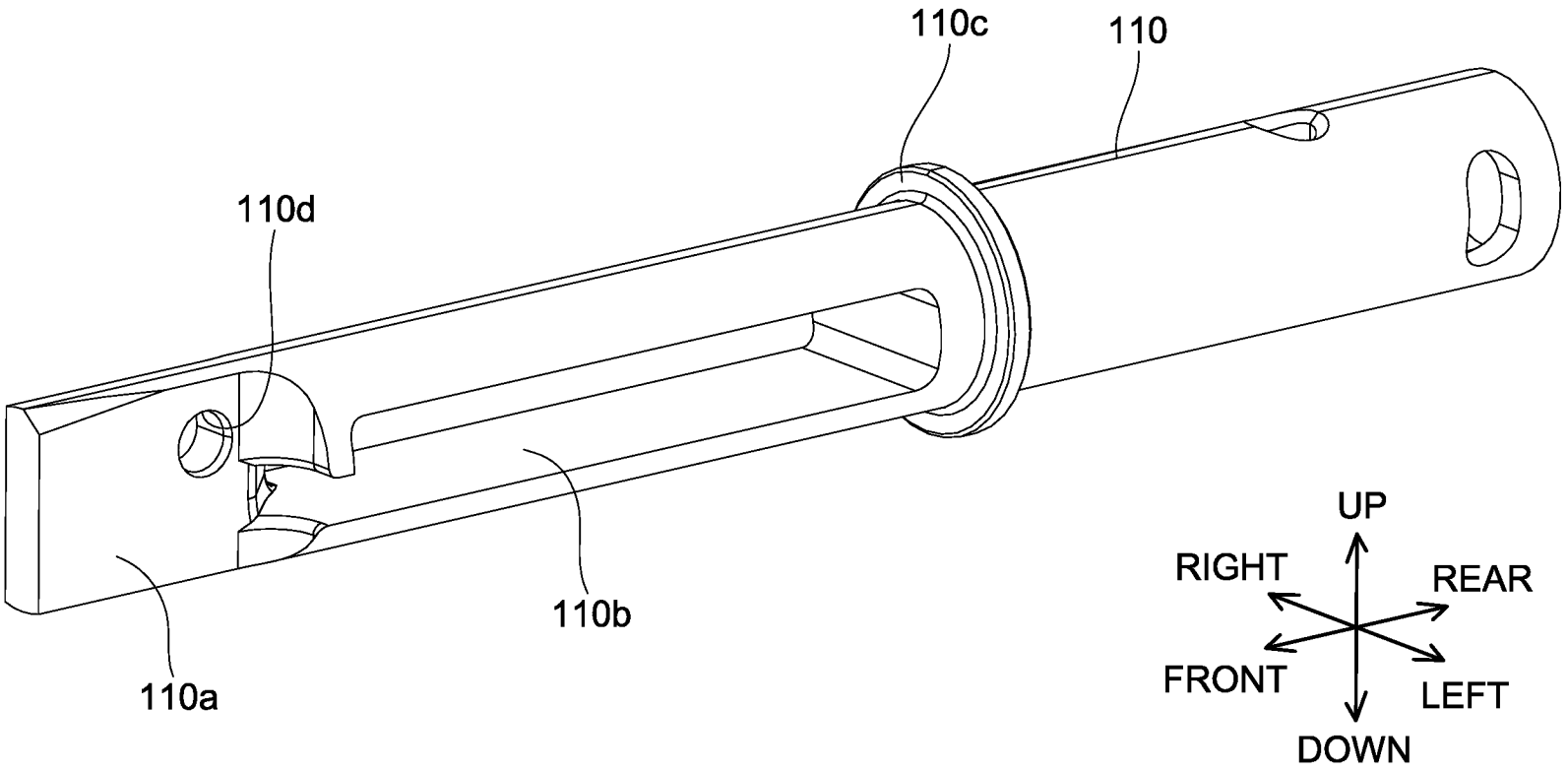
FIG. 12 is an oblique view of a clamp shaft 110 according to the working example.

The clamp shaft 110 is inserted into the inner sleeve 104 from the front side. The engaging part 102*e* of the screw shaft 102 is inserted into the rear end of the clamp shaft 110. The clamp shaft 110 is fixed to the screw shaft 102. As shown in FIG. 12, a flat-plate part 110*a* and a flange 110*c* are formed on the clamp shaft 110, and an opening 110*b* is formed in the clamp shaft 110. The flat-plate part 110*a* is disposed at a front end of the clamp shaft 110 and has a flat-plate shape along the up-down direction and the front-rear direction. A hole 110*d*, with which a pin 122 (refer to FIG. 13) mates, is formed in the flat-plate part 110*a*. The opening 110*b* is disposed rearward of the flat-plate part 110*a*. The opening 110*b* passes through the clamp shaft 110 in the left-right direction and extends in the front-rear direction. The flange 110*c* is disposed rearward of the opening 110*b* and protrudes in the radial direction.

Figure 13:
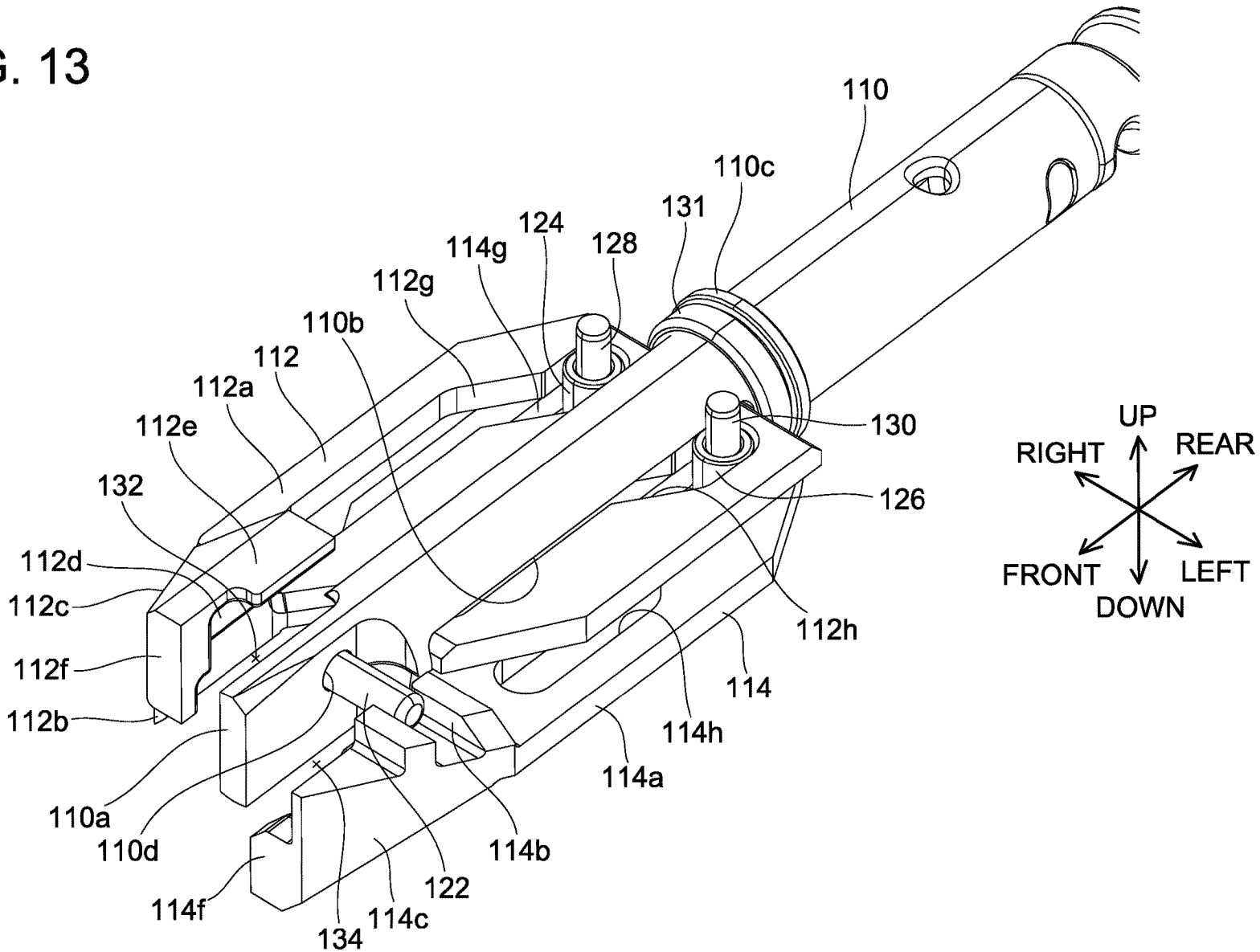
FIG. 13 is an oblique view of the twisting part 46 according to the working example in the state in which a right clamp 112 and a left clamp 114 are mounted on the clamp shaft 110.

As shown in FIG. 13, the right clamp 112 is mounted on the clamp shaft 110 such that the right clamp 112 passes through the opening 110*b* of the clamp shaft 110 from the right side to the left side. The left clamp 114 is disposed downward of the right clamp 112 and is mounted on the clamp shaft 110 such that the left clamp 114 passes through the opening 110*b* of the clamp shaft 110 from the left side to the right side.

Figure 14:
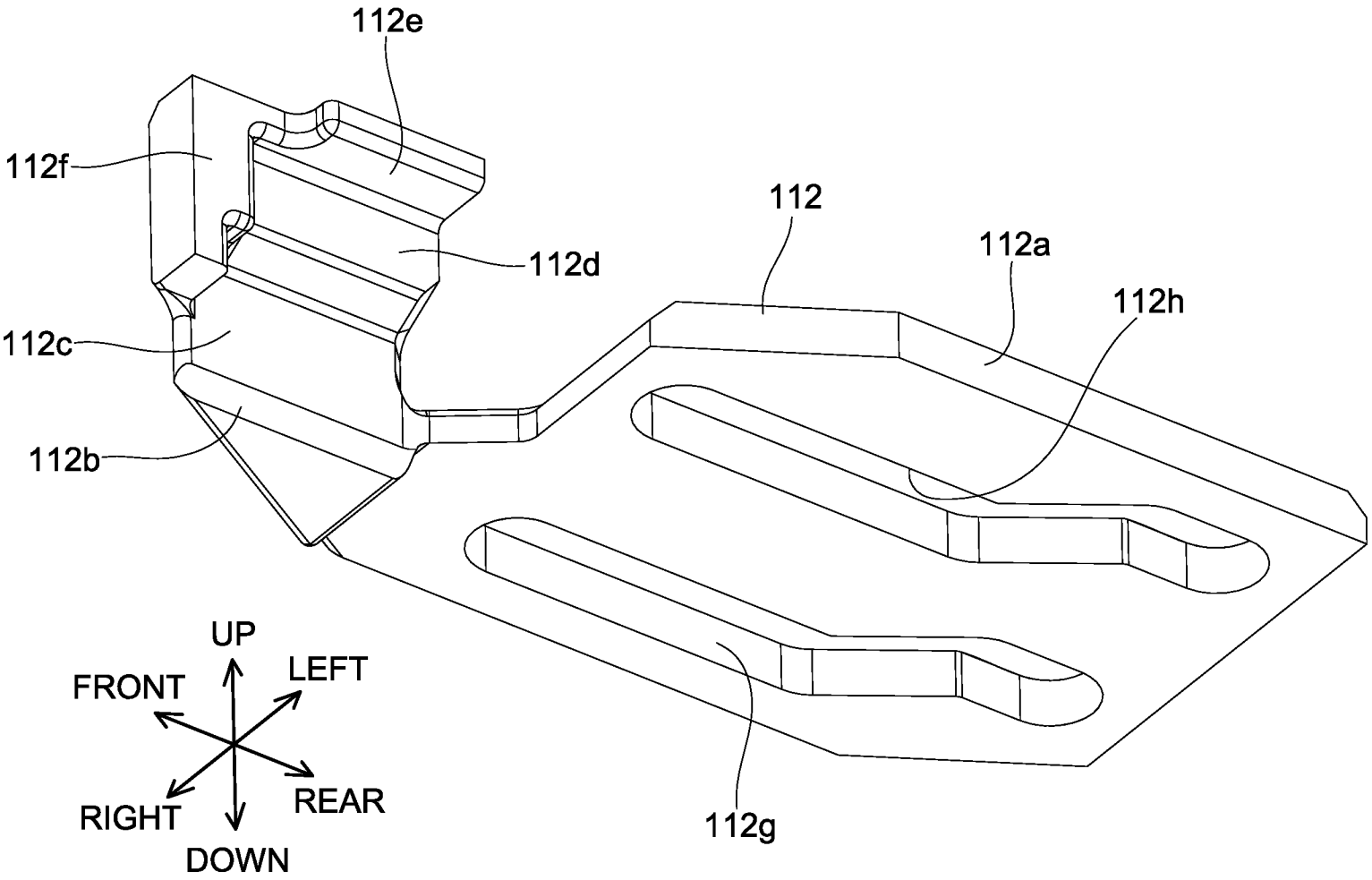
FIG. 14 is an oblique view of the right clamp 112 according to the working example.

As shown in FIG. 14, the right clamp 112 comprises a base part 112*a*, a downward protruding part 112*b*, an upward protruding part 112*c*, a contact part 112*d*, an upper-side guard part 112*e*, and a front-side guard part 112*f*. The base part 112*a* has a flat-plate shape along the front-rear direction and the left-right direction. The downward protruding part 112*b* is disposed at a right-end portion of the base part 112*a* and protrudes downward from the base part 112*a*. The upward protruding part 112*c* is disposed at a right-front end of the base part 112*a* and protrudes upward from the base part 112*a*. The contact part 112*d* protrudes leftward from the upper end of the upward protruding part 112*c*. The upper-side guard part 112*e* protrudes leftward from the upper end of the contact part 112*d*. The front-side guard part 112*f* protrudes leftward from the upward protruding part 112*c* and the front end of the contact part 112*d*. Cam holes 112*g*, 112*h* are formed in the base part 112*a*. Each of the cam holes 112*g*, 112*h* has an elongated shape that extends from the rear end to the front end first forward, then bends and extends rightward and forward, and thereafter bends and extends forward.

Figure 15:
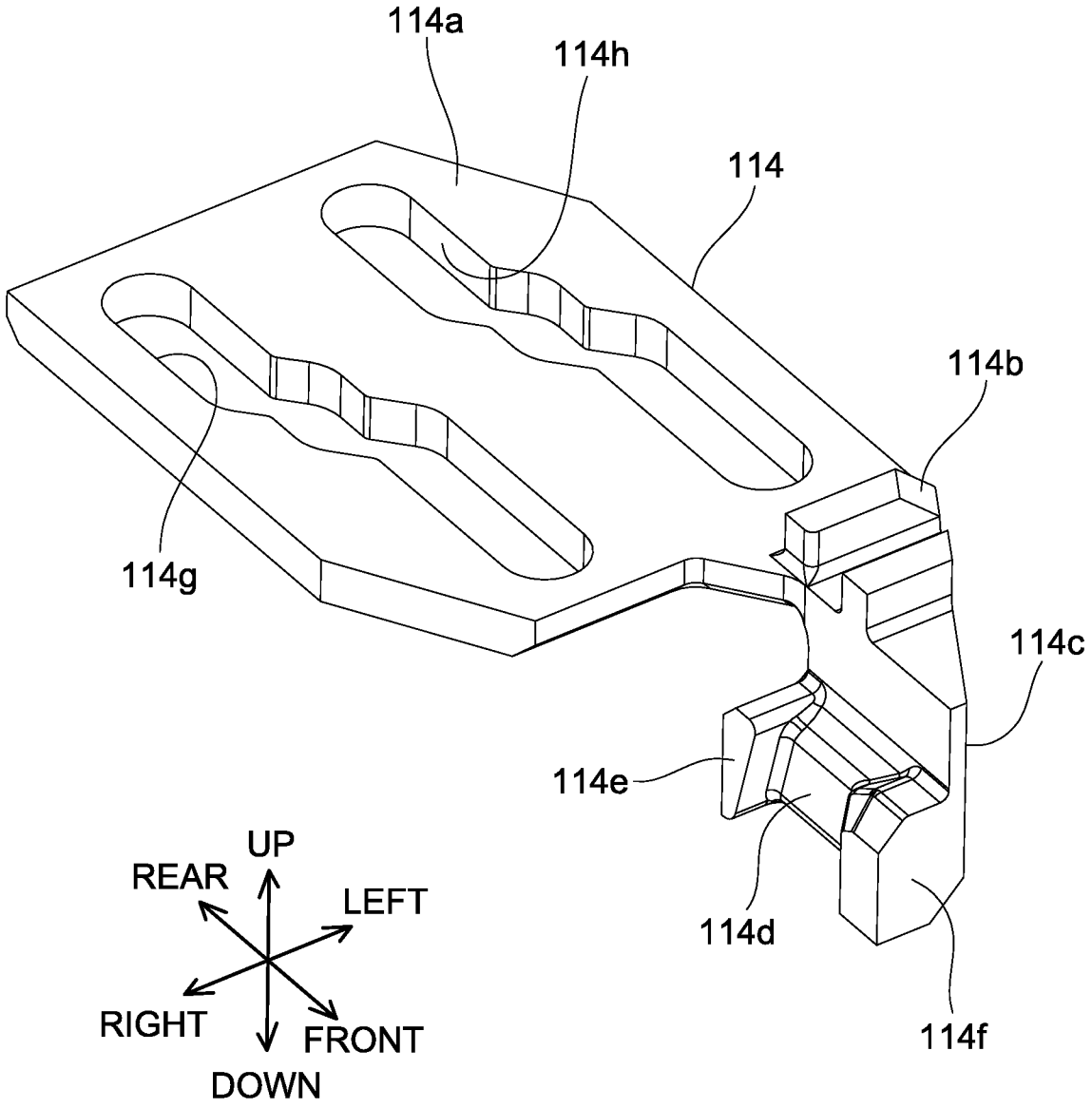
FIG. 15 is an oblique view of the left clamp 114 according to the working example.

As shown in FIG. 15, the left clamp 114 comprises a base part 114*a*, a pin-holding part 114*b*, a downward protruding part 114*c*, a contact part 114*d*, a rear-side guard part 114*e*, and a front-side guard part 114*f*. The base part 114*a* has a flat-plate shape along the front-rear direction and the left-right direction. The pin-holding part 114*b* is disposed at the left-front end of the base part 114*a*, is more upward than the base part 114*a*, and holds the pin 122 (refer to FIG. 13) in a slidable manner. The downward protruding part 114*c* is disposed at the left-front end of the base part 114*a* and protrudes downward from the base part 114*a*. The contact part 114*d* protrudes rightward from the lower end of the downward protruding part 114*c*. The rear-side guard part 114*e* protrudes rightward from the rear end of the contact part 114*d*. The front-side guard part 114*f* protrudes rightward from the front end of the contact part 114*d*. Cam holes 114*g*, 114*h* are formed in the base part 114*a*. Each of the cam holes 114*g*, 114*h* has an elongated shape that extends from the rear end to the front end first forward, then bends and extends leftward and forward, then bends and extends forward, and further bends and extends leftward and forward, after which it bends and extends forward.

As shown in FIG. 13, in the state in which the right clamp 112 and the left clamp 114 are mounted on the clamp shaft 110, a first cam sleeve 124 is disposed such that it passes through the cam hole 112*g* and the cam hole 114*g*, and a second cam sleeve 126 is disposed such that it passes through the cam hole 112*h* and the cam hole 114*h*. In addition, a first support pin 128 is disposed such that it passes through the first cam sleeve 124, and a second support pin 130 is disposed such that it passes through the second cam sleeve 126. A cushion 131, which has a circular-ring shape, is mounted between the right clamp 112 and the left clamp 114 on one side and the flange 110*c* of the clamp shaft 110 on the other side.

In the state in which the clamp shaft 110 is mounted on the inner sleeve 104 as shown in FIG. 9, the right clamp 112 and the left clamp 114 are respectively inserted into the slits 106*a* of the outer sleeve 106, and the first and second support pins 128, 130 are coupled to the outer sleeve 106. When the clamp shaft 110 moves in the front-rear direction relative to the outer sleeve 106, the first cam sleeve 124, which is mounted on the first support pin 128, moves in the front-rear direction within the cam holes 112*g*, 114*g*, and the second cam sleeve 126, which is mounted on the second support pin 130, moves in the front-rear direction within the cam holes 112*h*, 114*h*, and thereby the right clamp 112 and the left clamp 114 move in the left-right direction.

As shown in FIG. 13, in an initial state in which the clamp shaft 110 is protruding from the outer sleeve 106 in the forward direction, the right clamp 112 is located at its rightward-most position relative to the left clamp 114. In this state, a right-side wire passageway 132, through which the wire W passes, is formed between the upward protruding part 112*c* of the right clamp 112 and the flat-plate part 110*a* of the clamp shaft 110, and the upper side of the right-side wire passageway 132 is covered by the upper-side guard part 112*e*. This state of the right clamp 112 is called the fully open state. From this state, when the outer sleeve 106 moves forward relative to the clamp shaft 110, the right clamp 112 moves leftward toward the clamp shaft 110. In this state, the wire W is sandwiched between the lower end of the contact part 112*d* of the right clamp 112 and the upper end of the flat-plate part 110*a* of the clamp shaft 110, and the front side of the right-side wire passageway 132 is covered by the front-side guard part 112*f*. This state of the right clamp 112 is called the fully closed state.

In the initial state in which the clamp shaft 110 is protruding from the outer sleeve 106 in the forward direction, the left clamp 114 is located at its leftward-most position relative to the clamp shaft 110. In this state, a left-side wire passageway 134, through which the wire W passes, is formed between the downward protruding part 114*c* of the left clamp 114 and the flat-plate part 110*a* of the clamp shaft 110. This state of the left clamp 114 is called the fully open state. From this state, when the outer sleeve 106 moves forward relative to the clamp shaft 110, the left clamp 114 moves rightward toward the clamp shaft 110. In this state as well, although the wire W can pass through the left-side wire passageway 134, the rear side of the left-side wire passageway 134 is covered by the rear-side guard part 114*e*, and the front side of the left-side wire passageway 134 is covered by the front-side guard part 114*f*. This state of the left clamp 114 is called the semi-open state. From this state, when the outer sleeve 106 moves further forward relative to the clamp shaft 110, the left clamp 114 moves further rightward toward the clamp shaft 110. In this state, the wire W is sandwiched (interposed) between the upper end of the contact part 114*d* of the left clamp 114 and the lower end of the flat-plate part 110*a* of the clamp shaft 110. This state of the left clamp 114 is called the fully closed state.

The wire W fed from the feed part 38 (refer to FIG. 6) to the guide part 40 (refer to FIG. 6) passes through the left-side wire passageway 134 before reaching the guide part 40. Consequently, when the left clamp 114 reaches (assumes) the fully closed state and the wire W is cut by the cutting part 44 (refer to FIG. 6), the terminal end of the wire W wound around the rebars R is held by the left clamp 114 and the clamp shaft 110.

In addition, the wire W, which is guided by the guide part 40, passes through the right-side wire passageway 132. Consequently, when the right clamp 112 reaches (assumes) the fully closed state, the tip of the wire W wound around the rebars R is held by the right clamp 112 and the clamp shaft 110.

Figure 16:
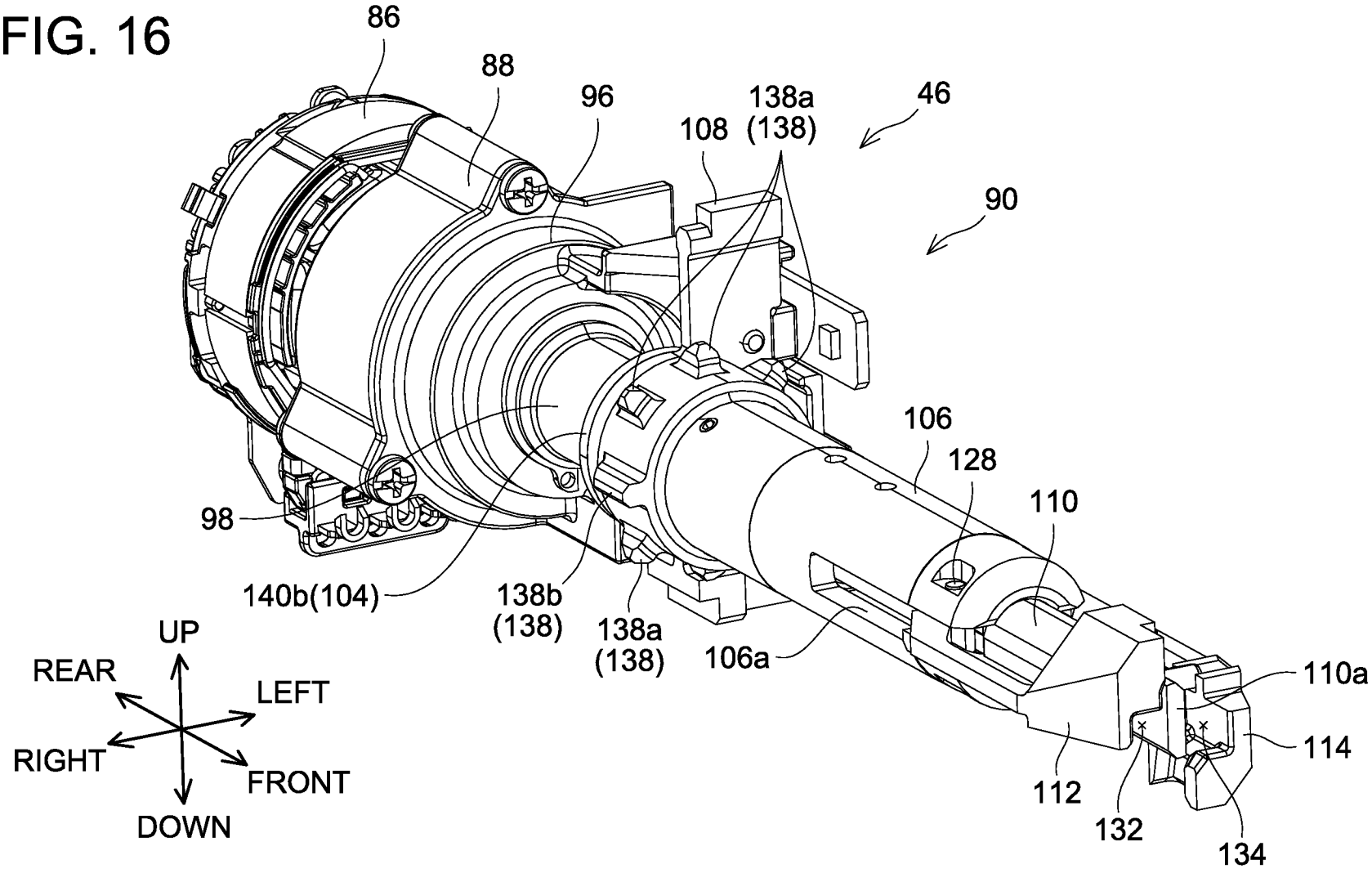
FIG. 16 is an oblique view of the twisting motor 86, the speed-reducing part 88, and the holding part 90 according to the working example.

As shown in FIG. 16, fins 138 are formed on the outer surface of a rear portion of the outer sleeve 106. The fins 138 extend in the front-rear direction. In the present working example, eight of the fins 138 are disposed on the outer-circumferential surface of the outer sleeve 106 at a spacing of 45° from each other. In addition, in the present working example, the eight fins 138 comprise seven short fins 138*a* and one long fin 138*b*. The length of the long fin 138*b* in the front-rear direction is longer than the length of the short fins 138*a* in the front-rear direction. In the front-rear direction, the location of the rear end of the long fin 138*b* is identical to the location of the rear end of each of the short fins 138*a*. In the front-rear direction, the front end of the long fin 138*b* is located more forward than the front end of each of the short fins 138*a*.

Figure 17:
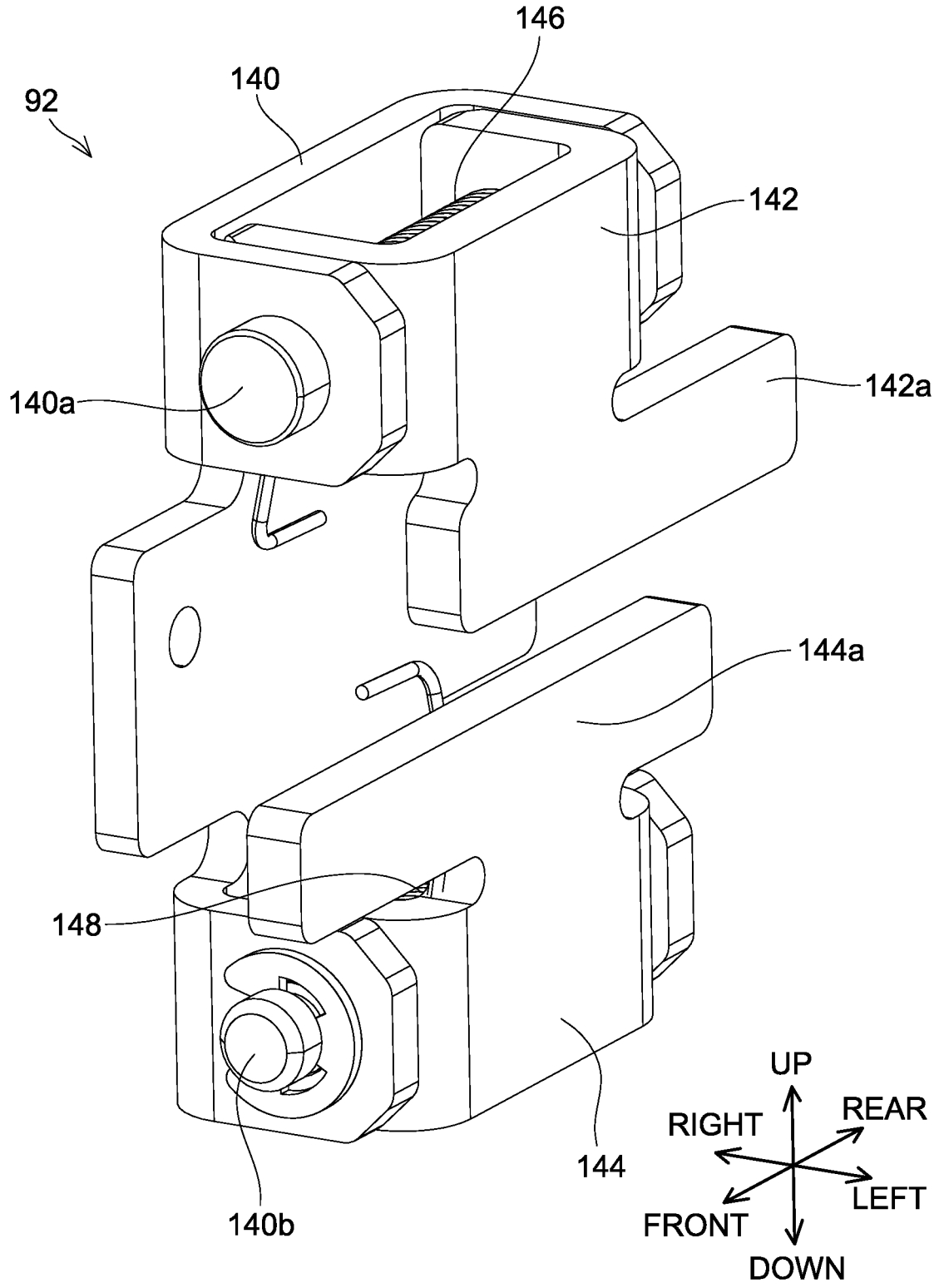
FIG. 17 is an oblique view of the rotation-blocking part 92 according to the working example.

The rotation-blocking part 92 is disposed at a location corresponding to the fins 138 of the outer sleeve 106. The rotation-blocking part 92 cooperates with the fins 138 to permit or prohibit (block) rotation of the outer sleeve 106. As shown in FIG. 17, the rotation-blocking part 92 comprises a base member 140, an upper stopper 142, a lower stopper 144, and torsion springs 146, 148. The base member 140 is fixed to the right housing half 18 (refer to FIG. 1). The upper stopper 142 is supported at an upper portion of the base member 140 in a swingable manner via a pivot shaft 140*a*. The upper stopper 142 comprises a blocking piece 142*a*. The blocking piece 142*a* is located at a lower portion of the upper stopper 142. The torsion spring 146 biases the blocking piece 142*a* in the direction in which the blocking piece 142*a* opens outward (i.e., in the direction in which the blocking piece 142*a* goes away from the base member 140). The lower stopper 144 is supported at a lower portion of the base member 140 in a swingable manner via a pivot shaft 140*b*. The lower stopper 144 comprises a blocking piece 144*a*. The blocking piece 144*a* is located at an upper portion of the lower stopper 144. The rear end of the blocking piece 144*a* is disposed forward of the rear end of the blocking piece 142*a*. The torsion spring 148 biases the blocking piece 144*a* in the direction in which the blocking piece 144*a* opens outward (i.e., in the direction in which the blocking piece 144*a* goes away from the base member 140).

When, relative to the upper stopper 142, the rotor of the twisting motor 86 (refer to FIG. 10) forwardly rotates and the screw shaft 102 (refer to FIG. 10) rotates in the direction of a left-hand screw viewed from the rear side, rotation of the outer sleeve 106 is prohibited (blocked) by the upper stopper 142 when the fins 138 (refer to FIG. 16) of the outer sleeve 106 make contact with the blocking piece 142*a*. On the other hand, when the twisting motor 86 reversely rotates and the screw shaft 102 rotates in the direction of a right-hand screw viewed from the rear side, the fins 138 of the outer sleeve 106 make contact with the blocking piece 142*a* and, as is, push in the blocking piece 142*a*. In this situation, the upper stopper 142 prohibits (blocks) rotation of the outer sleeve 106.

When, relative to the lower stopper 144, the rotor of the twisting motor 86 forwardly rotates and the screw shaft 102 rotates in the direction of a left-hand screw viewed from the rear side, even if the fins 138 of the outer sleeve 106 make contact with the blocking piece 144*a*, they push in, as is, the blocking piece 144*a*. In this situation, the lower stopper 144 does not prohibit (block) rotation of the outer sleeve 106. On the other hand, when the screw shaft 102 rotates in the direction of a right-hand screw viewed from the rear side, rotation of the outer sleeve 106 is prohibited (blocked) by the lower stopper 144 when the fins 138 of the outer sleeve 106 make contact with the blocking piece 144*a*.

Next, a representative, non-limiting operation of the rebar tying tool 2 shown in FIG. 1 will be explained. When the trigger 12 is manipulated (pressed) by the user, the rebar tying tool 2 performs a tying operation. When the rebar tying tool 2 performs the tying operation, the rebar tying tool 2 performs, e.g., an advancing process (wire advancing process), a tip-holding process (wire tip holding (clamping) process), a draw-back process (wire draw back (retraction) process), a terminal-end holding process (a wire terminal-end holding (clamping) process), a cutting process (wire severing process), a twisting process (wire-ends twisting together process), and a returning process in this order.

Advancing Process

When the rotor of the feed motor 50 shown in FIG. 4 forwardly rotates (i.e., rotates in direction D1 shown in FIG. 4) from the initial state of the rebar tying tool 2, the feed part 38 advances the wire W on the reel 33 by a prescribed length, so that the predetermined number of turns of the wire are wound (looped) around the rebar. This wire advancement (wire unreeling) causes the tip (front-end portion) of the wire W to pass through, in order, the fixed-cutter member 72, the movable-cutter member 74, the left-side wire passageway 134, the guide part 40, and the right-side wire passageway 132. Thereby, the wire W is wound (looped or wrapped) in a circular-ring-like manner or a loop around the rebars R. When the advancing of the wire W has completed, the feed motor 50 stops.

Tip-Holding Process

After the advancing process ends, the twisting motor 86 shown in FIG. 10 is energized to cause its rotor to forwardly rotate, whereby the screw shaft 102 is rotated in the direction of a left-hand screw. At this time, the rotation of the outer sleeve 106 in the direction of a left-hand screw is prohibited (block) by the rotation-blocking part 92. Consequently, the outer sleeve 106, together with the inner sleeve 104, advances relative to the clamp shaft 110, the right clamp 112 reaches the (its) fully closed state, and the left clamp 114 reaches the (its) semi-open state. Thereby, the tip (front-end portion, first terminal end portion) of the wire W is held by the right clamp 112 and the clamp shaft 110. When it is detected that the tip of the wire W is held, the twisting motor 86 stops.

Draw-Back Process

After the tip-holding process ends, the feed motor 50 shown in FIG. 4 is energized to cause its rotor to reversely rotate (i.e., rotate in direction D2 shown in FIG. 4), whereby the feed part 38 draws back (retracts, pulls back, tensions) the wire W wound (looped) around the rebars R. Because the tip of the wire W is held by the right clamp 112 and the clamp shaft 110, the circular-ring-like (loop) shape of the wire W around the rebars R shrinks in diameter. When the drawing back of the wire W is completed, the feed motor 50 stops.

Terminal-End Holding Process

After the draw-back process ends, the twisting motor 86 shown in FIG. 10 is energized to cause its rotor to forwardly rotate, whereby the screw shaft 102 is rotated in the direction of a left-hand screw. At this time, rotation of the outer sleeve 106 in the direction of a left-hand screw is prohibited (blocked) by the rotation-blocking part 92. Consequently, the outer sleeve 106, together with the inner sleeve 104, advances relative to the clamp shaft 110, and the left clamp 114 reaches the (its) fully closed state. Thereby, the terminal end (rear-end portion, second terminal end portion) of the wire W is held by the left clamp 114 and the clamp shaft 110.

Cutting Process

After the terminal-end holding process ends, the twisting motor 86 shown in FIG. 10 is energized to cause its rotor to forwardly rotate further, whereby the screw shaft 102 continues to rotate in the direction of a left-hand screw. At this time, rotation of the outer sleeve 106 in the direction of a left-hand screw is prohibited (blocked) by the rotation-blocking part 92. Consequently, the outer sleeve 106, together with the inner sleeve 104, further advances relative to the clamp shaft 110 and, as shown in FIG. 8, the push plate 108 pushes the upper end of the second lever member 78 downward and forward. Thereby, the wire W is cut (severed) by the fixed-cutter member 72 and the movable-cutter member 74. When the cutting of the wire W is complete, the twisting motor 86 stops.

Twisting Process

After the cutting process ends, the twisting motor 86 shown in FIG. 10 is energized to cause its rotor to forwardly rotate further, whereby the screw shaft 102 continues to rotate in the direction of a left-hand screw. At this time, rotation of the outer sleeve 106 in the direction of a left-hand screw is permitted by the rotation-blocking part 92. Consequently, the outer sleeve 106, the inner sleeve 104, the clamp shaft 110, the right clamp 112, and the left clamp 114 become integral and rotate together in the direction of a left-hand screw. Thereby, the end portions (i.e. the tip (front-end portion) and the terminal end (rear-end portion) of the wire W that has been wound around the rebars R are twisted together. When the twisting of the wire W is complete, the twisting motor 86 stops.

Returning Process

After the cutting process ends or after the twisting process ends, the twisting motor 86 shown in FIG. 10 is energized to cause its rotor to reversely rotate, whereby the screw shaft 102 rotates in the direction of a right-hand screw. At this time, rotation of the outer sleeve 106 in the direction of a right-hand screw is prohibited (blocked) by the rotation-blocking part 92. Consequently, the outer sleeve 106, together with the inner sleeve 104, retracts relative to the clamp shaft 110. The left clamp 114 transits the semi-open state and reaches the (its) fully open state, and the right clamp 112 reaches the fully open state. Subsequently, when rotation in the direction of a right-hand screw is permitted by the rotation-blocking part 92, the outer sleeve 106, the inner sleeve 104, the clamp shaft 110, the right clamp 112, and the left clamp 114 become integral and rotate together in the direction of a right-hand screw. When the long fin 138*b* makes contact with the lower stopper 144, rotation of the outer sleeve 106 is once again prohibited (blocked), and the outer sleeve 106, together with the inner sleeve 104, once again retract relative to the clamp shaft 110. When it is detected that the twisting part 46 has returned to the (its) initial state, the twisting motor 86 stops.

The rebar tying tool 2 according to the present working example can perform a single-winding-type tying operation, wherein the wire W is wound one turn around the rebars R and the one wire W is twisted. In addition, the rebar tying tool 2 according to the present working example can also perform a double-winding-type tying operation, wherein the wire W is wound two turns around the rebars R and two of the wires W are twisted at the same time, as will be further explained below.

Single-Winding-Type Tying Operation

When the single-winding-type tying operation is to be performed (i.e. the predetermined number of turns of the wire around the rebars is one), the rebar tying tool 2 performs, in order, the advancing process, the tip-holding process, the draw-back process, the terminal-end holding process, the cutting process, the twisting process, and the returning process. In this single-winding-type tying operation, the wire W is advanced by the feed part 38, the tip of the wire W is held by the twisting part 46, the wire W is drawn back by the feed part 38, the terminal end of the wire W is also held by the twisting part 46, and the wire W is cut by the cutting part 44. Thereafter, the first and second terminal end portions of the wire W are twisted together by the twisting part 46.

Double-Winding-Type Tying Operation

When the double-winding-type tying operation is performed (i.e. the predetermined number of turns of the wire around the rebars is two), first, the rebar tying tool 2 performs, in order, the advancing process, the tip-holding process, the draw-back process, the terminal-end holding process, and the cutting process, and then performs the returning process. In this double-winding-type tying operation, the first turn of the wire W is advanced by the feed part 38, the tip of the first turn of the wire W is held by the twisting part 46, the first turn of the wire W is drawn back by the feed part 38, the terminal end of the first turn of the wire W is also held by the twisting part 46, and the first turn of the wire W is cut by the cutting part 44. Thereafter, the twisting part 46 releases the holding of the tip and the holding of the rear end of the first turn of the wire W. Subsequently, the rebar tying tool 2 performs, in order, the advancing process, the tip-holding process, the draw-back process, the terminal-end holding process, the cutting process, the twisting process, and an initial-state returning process. At this time, the second turn of the wire W is advanced by the feed part 38, the tip of the first turn of the wire W and the tip of the second turn of the wire W are held by the twisting part 46, the second turn of the wire W is drawn back by the feed part 38, the terminal end portion of the first turn of the wire W and the terminal end portion of the second turn of the wire W are held by the twisting part 46, and the second turn of the wire W is cut by the cutting part 44. From this state, the terminal end portions of the first turn of the wire W and the terminal end portions of the second turn of the wire W are twisted together by the twisting part 46.

Configuration of Reel 33

As shown in FIG. 3, the reel 33 is held by the reel holder 10 in a rotatable manner. As shown in FIG. 4, the reel 33 comprises a bobbin 160 and the wire W, which is wound on the bobbin 160. The bobbin 160 comprises a substantially circular-tube-shaped trunk part and substantially disk-shaped flanges, which are disposed on both ends of the trunk part, and the wire W is wound on (around) the trunk part of the bobbin 160.

FIG. 18 shows, as a comparative example, the tensile strength, the wire diameter, the cross-sectional area, the winding count, the overall (total) cross-sectional area, the overall (total) maximum tensile load, the yield stress, and the overall (total) yield-point load of the wire W used in a rebar tying tool (not shown) according to pre-existing technology. FIG. 19 shows the tensile strength, the wire diameter, the cross-sectional area, the winding count (number of turns), the overall cross-sectional area, the overall maximum tensile load, the yield stress, and the overall yield-point load of the wire W used in the rebar tying tool 2 according to the present working example. It is noted that, in the present specification, the yield stress of the wire W means the stress at which the strain of the wire W is 0.2% (the so-called 0.2% proof stress), and the (overall) yield-point load of the wire W means the (overall) load at which the strain of the wire W is 0.2%.

As shown in FIG. 19, a variety of the wires W can be used in the rebar tying tool 2 of the present working example. For example, the material of the wire W may be annealed steel wire, zinc-plated wire, polyester-cord wire, stainless-steel wire, or the like. If the wire W is composed of annealed steel wire, zinc-plated wire, or polyester-cord wire, the tensile strength of the wire W is, for example, approximately 350 MPa, and the yield stress of the wire W is, for example, approximately 233 MPa. If the wire W is composed of stainless-steel wire, the tensile strength of the wire W is, for example, approximately 510 MPa, and the yield stress of the wire W is, for example, approximately 279 MPa. It is noted that the material of the wire W may be changed to a material having a higher tensile strength and/or yield stress or may be changed to a material having a lower tensile strength and/or yield stress.

For example, when the rebars R are tied together using the single-winding method of the rebar tying tool 2 (in FIG. 19, denoted as a Winding Count of 1), the diameter of the wire W (in FIG. 19, denoted as Wire Diameter) is 1.6 mm or more, or may be for example 2.0 mm or more, or may be for example 2.4 mm or more, or may be for example 2.8 mm or more, or may be for example 3.2 mm or more. It is noted that, when the rebars R are tied together using the single-winding method of the rebar tying tool 2, the limit of the maximum diameter of the wire W is approximately 5.0 mm. When the rebars R are tied together using the single-winding method of the rebar tying tool 2, the overall maximum tensile load of the wire W around the rebars R is equal to the maximum tensile load of a single wire W, because the predetermined number of turns of the wire W around the rebars R is one. If the tensile strength of the wire W is 350 MPa, the overall maximum tensile load of the wire W around the rebars R is 700 N or more, or may be for example 1,050 N or more, or may be for example 1,550 N or more, or may be for example 2,150 N or more, or may be for example 2,800 N or more. If the tensile strength of the wire W is 510 MPa, the overall maximum tensile load of the wire W around the rebars R is 1,000 N or more, or may be for example 1,600 N or more, or may be for example 2,300 N or more, or may be for example 3,100 N or more, or may be for example 4,100 N or more. Thus, by making the overall maximum tensile load of the wire W around the rebars R and/or by making the maximum tensile load per single wire W around the rebars R high, the wire W can be twisted with a stronger force, and thereby the rebars R can be more tightly tied. In addition, when the rebars R are tied using the single-winding method of the rebar tying tool 2, the overall yield-point load of the wire W around the rebars R is equal to the yield-point load of a single wire W, because the predetermined number of turns of the wire W around the rebars R is one. If the yield stress of the wire W is 233 MPa, the overall yield-point load of the wire W around the rebars R is 450 N or more, or may be for example 700 N or more, or may be for example 1,050 N or more, or may be for example 1,400 N or more, or may be for example 1,850 N or more. If the yield stress of the wire W is 279 MPa, the overall yield-point load of the wire W around the rebars R is 550 N or more, or may be for example 850 N or more, or may be for example 1,250 N or more, or may be for example 1,700 N or more, or may be for example 2,200 N or more. When a force that exceeds the overall yield-point load of the wire W around the rebars R acts on the wire W, the wire W that ties together the rebars R may deform in an adverse manner. When the wire W that ties the rebars R deforms in an adverse manner, one or more gaps is (are) formed between the rebars R and the wire W, and thereby the tying of the rebars R loosens in an adverse manner. As described above, by making the overall yield-point load of the wire W around the rebars R and/or the overall yield-point load per single wire W around the rebars R high, it is possible to make it more difficult for the wire W that ties together the rebars R to deform in an adverse manner, and thereby the rebars R can be tied more tightly.

In addition, when the rebars R are tied using the double-winding method of the rebar tying tool 2 (in FIG. 19, denoted as a Winding Count of 2), the diameter of the wire W (in FIG. 19, denoted as Wire Diameter) is 1.6 mm or more, or may be for example 2.0 mm or more, or may be for example 2.4 mm. It is noted that, when the rebars R are tied using the double-winding method of the rebar tying tool 2, the limit of the maximum diameter of the wire W is approximately 2.5 mm. The overall maximum tensile load of the wire W around the rebars R in this situation is equal to the maximum tensile load of two of the wires W, because the predetermined number of turns of the wire W around the rebars R is two. If the tensile strength of the wire W is 350 MPa, the overall maximum tensile load of the wire W around the rebars R is 1,400 N or more, or may be for example 2,150 N or more, or may be for example 3,150 N or more. If the tensile strength of the wire W is 510 MPa, then the overall maximum tensile load of the wire W around the rebars R is 2,050 N or more, or may be for example 3,200 N or more, or may be for example 4,600 N or more. Thus, by making the overall maximum tensile load of the wire W around the rebars R and/or the maximum tensile load per single wire W around the rebars R high, when the wire W is to be twisted, it is possible to reduce the likelihood of fracturing of the wire W, and therefore the wire W can be twisted with a stronger force, and the rebars R can be tied more tightly. In addition, when the rebars R are tied using the double-winding method of the rebar tying tool 2, the overall yield-point load of the wire W around the rebars R is equal to the yield-point load of two of the wires W, because the predetermined number of turns of the wire W around the rebars R is two. If the yield stress of the wire W is 233 MPa, the overall yield-point load of the wire W around the rebars R is 900 N or more, or may be for example 1,450 N or more, or may be for example 2,100 N or more. If the yield stress of the wire W is 279 MPa, the overall yield-point load of the wire W around the rebars R is 1,100 N or more, or may be for example 1,750 N or more, or may be for example 2,500 N or more. When a force that exceeds the overall yield-point load of the wire W around the rebars R acts on the wire W, the wire W that ties together the rebars R deforms in an adverse manner. When the wire W that ties the rebars R deforms in an adverse manner, a gap or gaps is (are) formed between the rebars R and the wire W, and thereby the tying (binding) of the rebars R loosens in an adverse manner. As described above, by making the overall yield-point load of the wire W around the rebars R and/or the yield-point load per single wire W around the rebars R high, it is possible to make it more difficult for the wire W that ties together the rebars R to deform in an adverse manner, and thereby the rebars R can be tied more tightly.

With regard to the rebar tying tool 2 of the present working example, the bobbin 160 having a trunk-part diameter of 50 mm or more, or for example 52 mm or more, or for example 54 mm or more, is used as the bobbin 160 of the reel 33 shown in FIG. 4. By employing such a configuration, it is possible to reduce the likelihood of fracturing of the wire W caused by winding the wire W on (around) the bobbin 160. With regard to the rebar tying tool 2 of the present working example, in the guide part 40 shown in FIG. 3, the spacing between the tip of the upper-side curl guide 70 and the tip of the lower-side curl guide 71 is within the range of, for example, 50-80 mm. If a winding curl (curve plastic deformation) were to be adversely imparted to the wire W due to the wire W being wound on the bobbin 160, then there would be a risk that, in the guide part 40, the tip of the wire W advanced from the upper-side wire passageway 70*a* of the upper-side curl guide 70 will not enter the lower-side wire passageway 71*a* of the lower-side curl guide 71, and therefore it would no longer be possible to guide the wire W around the rebars R. According to the above-mentioned configuration, in the guide part 40, the tip of the wire W that has passed through the upper-side wire passageway 70*a* of the upper-side curl guide 70 can reliably be fed to the lower-side wire passageway 71*a* of the lower-side curl guide 71.

With regard to the rebar tying tool 2 according to the present working example, in the feed part 38 shown in FIG. 4, the biasing force of the compression spring 68 is adjusted such that the second feed gear 64 pushes against the first feed gear 62 with a force of 60 N or more, or for example 80 N or more, or for example 100 N or more, or for example 120 N or more, or for example 140 N or more, or for example 160 N or more, or for example 180 N. By employing such a configuration, even if the diameter of the wire W is large, the advancing and the drawing back of the wire W can be performed reliably.

With regard to the rebar tying tool 2 according to the present working example, in the feed part 38, a metal having a hardness of 56 HRC or more, or for example a hardness of 58 HRC or more, or for example a hardness of 60 HRC or more, or for example a hardness of 62 HRC or more, or for example a hardness of 64 HRC or more, or for example a hardness of 66 HRC or more is used as the material of the first feed gear 62 and the second feed gear 64. By employing such a configuration, even if the diameter of the wire W is large and, attendant therewith, the first feed gear 62 and the second feed gear 64 are strongly pressed against the wire W, wear of the first feed gear 62 and the second feed gear 64 can be curtailed.

With regard to the rebar tying tool 2 according to the present working example, in the feed part 38, a motor having a rated output within the range of 100-500 W, or for example within the range of 150-400 W, is used as the feed motor 50. By employing such a configuration, even if the diameter of the wire W is large, the advancing and drawing back of the wire W can be performed reliably.

With regard to the rebar tying tool 2 of the present working example, in the guide part 40 shown in FIG. 3, a metal having a hardness of 56 HRC or more, or for example a hardness of 58 HRC or more, or for example a hardness of 60 HRC or more, or for example a hardness of 62 HRC or more, or for example a hardness of 64 HRC or more, or for example a hardness of 66 HRC or more, is used as the material of the upper-side curl guide 70 and the lower-side curl guide 71. By employing such a configuration, even if the diameter of the wire W is large, it is possible to better reduce the likelihood and/or amount of wear caused by the wire contacting the upper-side curl guide 70 and the lower-side curl guide 71, e.g., during the advancing process (i.e. while the wire W is being plastically deformed into a loop shape.

With regard to the rebar tying tool 2 of the present working example, in the cutting part 44 shown in FIG. 6, a metal having a hardness of 56 HRC or more, or for example a hardness of 58 HRC or more, or for example a hardness of 60 HRC or more, or for example a hardness of 62 HRC or more, or for example a hardness of 64 HRC or more, or for example a hardness of 66 HRC or more, is used as the material of the fixed-cutter member 72 and the movable-cutter member 74. By employing such a configuration, even if the diameter of the wire W is large, it is possible to reduce the likelihood and/or amount of wear of the fixed-cutter member 72 and the movable-cutter member 74 caused by repetitively cutting the wire W.

With regard to the rebar tying tool 2 according to the present working example, in the twisting part 46 shown in FIG. 9, a metal having a hardness of 56 HRC or more, or for example a hardness of 58 HRC or more, or for example a hardness of 60 HRC or more, or for example a hardness of 62 HRC or more, or for example a hardness of 64 HRC or more, or for example a hardness of 66 HRC or more, is used as the material of the clamp shaft 110, the right clamp 112, and the left clamp 114. By employing such a configuration, even if the diameter of the wire W is large, it is possible to reduce the likelihood and/or amount of wear of the clamp shaft 110, the right clamp 112, and the left clamp 114 caused by the wire W sliding relative to (against) the clamp shaft 110, the right clamp 112, and the left clamp 114 in the advancing process and the draw-back process.

With regard to the rebar tying tool 2 according to the present working example, in the twisting part 46, a motor having a rated output within the range of 100-500 W, or for example within the range of 150-400 W, is used as the twisting motor 86. By employing such a configuration, even if the diameter of the wire W is large, the twisting of the end portions of the wire W can be performed reliably, and thereby the wire W can be tightly tied.

MODIFIED EXAMPLES

In the tying operation of the rebar tying tool 2 described above, the draw-back process may be omitted for either the single-winding method or the double-winding method.

In the rebar tying tool 2 described above, the feed motor 50 and/or the twisting motor 86 may be a brushed DC motor, or may be an AC motor, or may be some other type of motor.

In the rebar tying tool 2 described above, the reel holder 10, the feed part 38, the guide part 40, the cutting part 44, and the twisting part 46 may be differently arranged. For example, the reel holder 10 may be disposed on a rear-side upper portion of the main body 4, the feed part 38 may be disposed between the reel holder 10 and the guide part 40 at an upper portion of the main body 4, or the cutting part 44 may be disposed between the feed part 38 and the guide part 40 in the interior of the main body 4.

In the rebar tying tool 2 described above, the right clamp 112 and the clamp shaft 110 may be configured such that they do not hold the tip of the wire W, or the left clamp 114 and the clamp shaft 110 may be configured such that they do not hold the terminal end of the wire W; and in the tying operation of the rebar tying tool 2, the tip-holding process and the terminal-end holding process may be omitted. In such a modified embodiment, in the twisting process, the wire W that has been wound around the rebars R is twisted by being wound in response to the rotation of the clamp shaft 110, the right clamp 112, and the left clamp 114.

In the rebar tying tool 2 described above, instead of the battery-mount part 8, on which the battery pack B is mountable, a power-supply-cord connecting part, to which a power-supply cord that supplies electric power from an external power supply can connect, may be provided. In this situation, the rebar tying tool 2 operates using electric power supplied via the power-supply cord.

Instead of the rebar tying tool 2 being used by the user gripping the grip 6, the rebar tying tool 2 may be used by being installed on a rebar-tying robot that comprises a transport unit, which transports the rebar tying tool 2, and a manipulation unit, which manipulates the trigger 12.

Features of the Embodiments

In one or more of the embodiments as described above, the rebar tying tool 2 ties together the rebars R using the wire W. The rebar tying tool 2 comprises: the reel 33 comprising the bobbin 160 and the wire W, which is wound on the bobbin 160; the reel-holding part 10 (example of reel-holding part) configured to hold the reel 33 in a rotatable manner; the feed part 38 configured to advance the wire W from the reel 33 a predetermined number of turns around the rebars R; and the twisting part 46 configured to twist the wire W that has been looped around the rebars R. The overall maximum tensile load of the wire W after the wire W has been wound around the rebars R by the predetermined number of turns is 1,050 N or more.

As was described above, to tightly tie together the rebars R, it is necessary to twist the wire W that is looped around the rebars R with a strong force. Nevertheless, if the overall maximum tensile load of the wire W around the rebars R is small, when the wire W that is around the rebars R is twisted with a strong force, there is a risk that the wire W will fracture. According to the above-mentioned configuration, because the overall maximum tensile load of the wire W around the rebars R is 1,050 N or more, even if the wire W that is around the rebars R is twisted with a strong force, it is possible to reduce the likelihood of fracturing of the wire W. By employing such a configuration, the rebars R can be tied more tightly.

In one or more embodiments, the overall maximum tensile load of the wire W around the rebars R is within the range of 1,050-4,700 N.

Generally speaking, to make the overall maximum tensile load of the wire W around the rebars R large, it is necessary to make the number and diameter of the wires W large. Nevertheless, if the number of turns and/or the diameter of the wires W is (are) excessively large, then there is a risk that an excessive load will act on the motive-power source (e.g., the twisting motor 86) that drives the twisting part 46. According to the above-mentioned configuration, the rebars R can be tied more tightly while reducing the likelihood that an excessive load will act on the motive-power source that drives the twisting part 46 during the twisting operation.

In one or more embodiments, the rebar tying tool 2 ties together rebars R using the wire W. The rebar tying tool 2 comprises: the reel 33 comprising the bobbin 160 and the wire W, which is wound on the bobbin 160; the reel-holding part 10 (example of a reel-holding part) configured to hold the reel 33 in a rotatable manner; the feed part 38 configured to advance the wire W around the rebars R from the reel 33; and the twisting part 46 configured to twist the wire W that is around the rebars R. The overall yield-point load of the wire W after the wire W has been wound around the rebars R by the predetermined number of turns is 700 N or more.

If the wire W that ties together the rebars R deforms in an adverse manner, one or more gaps may form between the rebars R and the wire W, and thereby the tying (binding) of the rebars R will loosen in an adverse manner. Consequently, to tightly tie the rebars R together, it is necessary to make it difficult for the wire W that ties together the rebars R to deform. Nevertheless, if the overall yield-point load of the wire W around the rebars R is small, if a strong force acts on the wire W that ties together the rebars R, there is a risk that the wire W will deform in an adverse manner. According to the above-mentioned configuration, because the overall yield-point load of the wire W around the rebars R is 700 N or more, even if a strong force acts on the wire W that ties the rebars R, it is possible to reduce the likelihood of adverse deformation of the wire W. By employing such a configuration, the rebars R can be tied more tightly.

In one or more embodiments, the overall yield-point load of the wire W around the rebars R is within the range of 700-2,550 N.

Generally speaking, if the overall yield-point load of the wire W around the rebars R is excessively large, it becomes difficult for the wire W to tightly contact the outer-circumferential surfaces of the rebars R, and thereby one or more gaps may adversely form between the wire W and the rebars R, and it becomes difficult to tightly tie together the rebars R. According to the above-mentioned configuration, the rebars R can be tied more tightly.

In one or more embodiments, the twisting part 46 comprises the holding part 90 (example of a tip-holding part) configured to hold the tip of the wire W that has advanced around the rebars R. The feed part 38 is configured to draw back the wire W after the holding part 90 holds the tip of the wire W and before the twisting part 46 twists the wire W.

According to the above-mentioned configuration, because the feed part 38 draws back the wire W, when the twisting part 46 twists the wire, the wire W can be twisted from a state in which the wire W has been brought into tighter contact with the rebars R. By employing such a configuration, the rebars R can be tied more tightly.

In one or more embodiments, the diameter of the wire W may be 1.6 mm or more.

According to the above-mentioned configuration, the rebars R can be tied together more tightly.

In one or more embodiments, the diameter of the trunk part of the bobbin 160 is 50 mm or more.

According to the above-mentioned configuration, it is possible to reduce the likelihood of a winding curl being imparted to the wire W due to the wire W being wound (and stored) on the bobbin 160.

In one or more embodiments, the feed part 38 comprises the first feed gear 62 and the second feed gear 64 (example of feed rollers), which advances the wire W by rotating. The hardness of the first feed gear 62 and the second feed gear 64 is 56 HRC or more.

According to the above-mentioned configuration, it is possible to reduce the likelihood and/or amount of adverse wear of the first feed gear 62 and the second feed gear 64 when the feed part 38 advances the wire W.

In one or more embodiments, the rebar tying tool 2 further comprises the cutting part 44 comprising the fixed-cutter member 72 and the movable-cutter member 74 (example of cutters) that cut the wire W. The hardness of the fixed-cutter member 72 and the movable-cutter member 74 is 56 HRC or more.

According to the above-mentioned configuration, it is possible to reduce the likelihood and/or amount of adverse wear of the fixed-cutter member 72 and the movable-cutter member 74 when the cutting part 44 cuts the wire W.

In one or more embodiments, the rebar tying tool 2 further comprises the grip 6, which the user grips. The user is capable of performing the work of tying the rebars R in the state in which the user grips the rebar tying tool 2 with their hand.

According to the above-mentioned configuration, the rebars R can be tied together more tightly by using the hand-held type rebar tying tool 2.

In one or more embodiments, the rebar tying tool 2 ties together rebars R using the wire W. The rebar tying tool 2 comprises: the reel 33 comprising the bobbin 160 and the wire W, which is wound on the bobbin 160; the reel holder 10 (example of a reel-holding part) configured to hold the reel 33 in a rotatable manner; the feed part 38 configured to advance the wire W around the rebars R from the reel 33; and the twisting part 46 configured to twist the wire W that is around the rebars R. The maximum tensile load per single wire W around the rebars R is 700 N or more.

To tightly tie the rebars R, it is necessary to twist the wire W that is around the rebars R with a strong force. Nevertheless, if the maximum tensile load per single wire W around the rebars R is small, when the wire W that has been around the rebars R is twisted with a strong force, there is a risk that the wire W will fracture. According to the above-mentioned configuration, because the maximum tensile load per single wire W around the rebars R is 700 N or more, even if the wire W that is around the rebars R is twisted with a strong force, it is possible to reduce the likelihood of fracturing of the wire W. By employing such a configuration, the rebars R can be tied more tightly.

In one or more embodiments, the rebar tying tool 2 ties together rebars R using the wire W. The rebar tying tool 2 comprises: the reel 33 comprising the bobbin 160 and the wire W, which is wound on the bobbin 160; the reel holder 10 (example of the reel-holding part) configured to hold the reel 33 in a rotatable manner; the feed part 38 configured to advance the wire W around the rebars R from the reel 33; and the twisting part 46 configured to twist the wire W that is around the rebars R. The yield-point load per single wire W around the rebars R is 450 N or more.

If the wire W that ties together the rebars R deforms in an adverse manner, a gap or gaps will be formed between the rebars R and the wire W, and therefore the tying of the rebars R will loosen in an adverse manner. Consequently, to tie together the rebars R tightly, it is necessary to make it difficult for the wire W that ties together the rebars R to deform. Nevertheless, if the yield-point load per single wire W around the rebars R is small, if a strong force acts on the wire W that ties the rebars R, then there is a risk that the wire W will deform in an adverse manner. According to the above-mentioned configuration, because the yield-point load per single wire W around the rebars R is 450 N or more, even if a strong force acts on the wire W that ties together the rebars R, it is possible to reduce the likelihood of adverse deformation of the wire W. By employing such a configuration, the rebars R can be tied together more tightly.

Additional teachings, embodiments, structures, circuits, processes, methods, advantages, etc., which are combinable with the rebar tying tools described herein to develop additional embodiments of the present teachings, are disclosed in the Applicant's U.S. Pat. Nos. 11,529,669 and 11,554,409, the contents of which are fully incorporated herein by reference.

EXPLANATION OF THE REFERENCE NUMBERS

2 Rebar tying tool
4 Main body
6 Grip
8 Battery-mount part
10 Reel holder
12 Trigger
14 Trigger switch
15 Support part
16 Housing
16*a* Window
18 Right housing half
20 Left housing half
22 Motor cover
24 Operation-and-display part
24*a* Main power-supply switch
24*b* Main power-supply LED
26 Holder housing
26*a* Pivot shaft
26*b* Housing space
26*c* Hole
28 Main cover
30 Auxiliary cover
30*a* Auxiliary space
31 Torsion spring
32 Lock lever
33 Reel
36 Control circuit board
38 Feed part
40 Guide part
44 Cutting part
46 Twisting part
50 Feed motor
52 Speed-reducing part
54 Feed unit
56 Base member
58 Guide member
58*a* Guide hole
60 Drive gear
62 First feed gear
62*a* Groove
64 Second feed gear
64*a* Groove
66 Release lever
66*a* Pivot shaft
68 Compression spring
70 Upper-side curl guide
70*a* Upper-side wire passageway
71 Lower-side curl guide
71*a* Lower-side wire passageway
72 Fixed-cutter member
72*a* Hole
74 Movable-cutter member
74*a* Hole
76 First lever member
78 Second lever member
80 Link member
82 Torsion spring
86 Twisting motor
88 Speed-reducing part
90 Holding part
92 Rotation-blocking part
96 Bearing box
96*a* Bearing
98 Carrier sleeve
98*a* Clutch groove
98*b* First wall part
98*c* Second wall part
100 Clutch plate
100*a* Clutch piece
102 Screw shaft
102*a* Rear part
102*b* Front part
102*c* Flange
102*d* Ball groove
102*e* Engaging part
104 Inner sleeve
104*a* Ball hole
104*b* Flange
106 Outer sleeve
106*a* Slit
108 Push plate
110 Clamp shaft
110*a* Flat-plate part
110*b* Opening
110*c* Flange
110*d* Hole
112 Right clamp
112*a* Base part
112*b* Downward protruding part
112*c* Upward protruding part
112*d* Contact part
112*e* Upper-side guard part
112*f* Front-side guard part
112*g* Cam hole
112*h* Cam hole
114 Left clamp
114*a* Base part
114*b* Pin-holding part
114*c* Downward protruding part
114*d* Contact part
114*e* Rear-side guard part
114*f* Front-side guard part
114*g* Cam hole
114*h* Cam hole
116 Compression spring
118 Compression spring
120 Ball
122 Pin
124 Cam sleeve
126 Cam sleeve
128 Support pin
130 Support pin
131 Cushion
132 Right-side wire passageway
134 Left-side wire passageway
138 Fin
138*a* Short fin
138*b* Long fin
140 Base member
140*a* Pivot shaft
140*b* Pivot shaft
142 Upper stopper
142*a* Blocking piece
144 Lower stopper
144*a* Blocking piece
146 Torsion spring
148 Torsion spring
160 Bobbin

The invention claimed is:

1. A rebar tying tool configured to tie together rebars using a wire, comprising:

a reel having the wire wound on a bobbin;

a reel-holding part configured to hold the reel in a rotatable manner;

a feed part configured to advance the wire from the reel by a number of turns of the wire around the rebars; and a twisting part configured to twist the wire after the number of turns of the wire has been wound around the rebars;

wherein the rebar tying tool is configured such that the following conditions are satisfied:

the wire has a maximum tensile load of at least 700 N;

the wire after the number of turns of the wire has been wound around the rebars has an overall maximum tensile load of at least 1,050 N, the overall maximum tensile load being calculated by multiplying the maximum tensile load of the wire by the number of turns of the wire around the rebars;

the wire has a yield-point load of at least 450 N; and the wire after the number of turns of the wire has been wound around the rebars has an overall yield-point load of at least 700 N, the overall yield-point load being calculated by multiplying the yield-point load of the wire by the number of turns of the wire around the rebars.

2. The rebar tying tool according to claim 1, wherein the overall maximum tensile load of the wire is within the range of 1,050-4,700 N.

3. The rebar tying tool according to claim 2, wherein the number of turns of the wire around the rebars is two.

4. The rebar tying tool according to claim 1, wherein:

the twisting part comprises a tip-holding part configured to hold a tip of the wire that has been advanced around the rebars; and the feed part is configured to draw back the wire after the tip-holding part holds the tip of the wire and before the twisting part twists the wire.

5. The rebar tying tool according to claim 1, wherein the wire has a diameter of at least 1.6 mm.

6. The rebar tying tool according to claim 1, wherein a trunk part of the bobbin has a diameter of at least 50 mm.

7. The rebar tying tool according to claim 1, wherein:

the feed part comprises feed rollers configured to advance the wire by rotating; and the feed rollers have a hardness of at least 56 HRC.

8. The rebar tying tool according to claim 1, further comprising:

a cutting part comprising cutters configured to cut the wire;

wherein the cutters have a hardness of at least 56 HRC.

9. The rebar tying tool according to claim 1, further comprising:

a grip configured to be grasped by a user during a rebar tying operation to perform the rebar tying operation in a hand-held state.

10. The rebar tying tool according to claim 3, wherein:

the twisting part comprises a tip-holding part configured to hold a tip of the wire that has been advanced around the rebars; and the feed part is configured to draw back the wire after the tip-holding part holds the tip of the wire and before the twisting part twists the wire.

11. The rebar tying tool according to claim 10, wherein:

the wire has a diameter of at least 1.6 mm;

a trunk part of the bobbin has a diameter of at least 50 mm;

the feed part comprises feed rollers configured to advance the wire by rotating, the feed rollers having a hardness of at least 56 HRC; and further comprising:

a cutting part comprising cutters configured to cut the wire, the cutters having a hardness of at least 56 HRC; and a grip configured to be grasped by a user during a rebar tying operation to perform the rebar tying operation in a hand-held state.

12. The rebar tying tool according to claim 1, wherein the overall yield-point load of the wire is within the range of 700-2,550 N.

13. The rebar tying tool according to claim 12, wherein:

the twisting part comprises a tip-holding part configured to hold a tip of the wire that has been advanced around the rebars; and the feed part is configured to draw back the wire after the tip-holding part holds the tip of the wire and before the twisting part twists the wire.

14. The rebar tying tool according to claim 13, wherein the diameter of the wire is at least 1.6 mm.

15. The rebar tying tool according to claim 14, wherein the diameter of a trunk part of the bobbin is at least 50 mm.

16. The rebar tying tool according to claim 15, wherein:

the feed part comprises feed rollers configured to advance the wire by rotating; and the feed rollers have a hardness at least 56 HRC.

17. The rebar tying tool according to claim 16, further comprising:

a cutting part comprising cutters configured to cut the wire;

wherein the cutters have a hardness of at least 56 HRC.

18. The rebar tying tool according to claim 17, further comprising:

a grip configured to be grasped by a user during a rebar tying operation to perform the rebar tying operation in a hand-held state.

19. The rebar tying tool according to claim 1, wherein the yield-point load of the wire is at least 450 N.

* * * * *